US006203149B1

(12) United States Patent
Watanabe et al.

(10) Patent No.: US 6,203,149 B1
(45) **Date of Patent: *Mar. 20, 2001**

(54) INK JET CARTRIDGE, INK JET APPARATUS AND INK CONTAINER

(75) Inventors: Kenjiro Watanabe, Tokyo; Hidemi Kubota, Komae, both of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/298,957

(22) Filed: Apr. 26, 1999

Related U.S. Application Data

(62) Division of application No. 08/631,033, filed on Apr. 18, 1996, now Pat. No. 5,940,102, which is a continuation of application No. 08/181,180, filed on Jan. 13, 1994, now abandoned.

(30) Foreign Application Priority Data

Jan. 19, 1993 (JP) ..... 5-006986
Dec. 28, 1993 (JP) ..... 5-336703

(51) Int. Cl.[7] ..... B41J 2/175
(52) U.S. Cl. ..... 347/86
(58) Field of Search ..... 347/85, 86, 87, 347/84, 49

(56) References Cited

U.S. PATENT DOCUMENTS

| | | | |
|---|---|---|---|
| 4,419,678 | 12/1983 | Kasugayama | 347/86 R |
| 4,760,408 | 7/1988 | Kanayama | 347/15 R |
| 4,760,409 | 7/1988 | Kiyohara | 347/86 |
| 4,791,439 | 12/1988 | Guiles | 347/88 |
| 4,878,069 | 10/1989 | Kiyohara | 347/86 |
| 5,023,629 | 6/1991 | Kiyohara | 12/12.4 |
| 5,138,344 | 8/1992 | Ujita | 347/86 |
| 5,216,448 | 6/1993 | Unosawa | 347/49 |
| 5,245,361 | 9/1993 | Kashimura | 347/50 |
| 5,583,549 * | 12/1996 | Ujita et al. | 347/86 |
| 6,113,223 | 9/2000 | Tanaka et al. | 347/65 |

FOREIGN PATENT DOCUMENTS

| | | |
|---|---|---|
| 299360 | 4/1992 | (DE) . |
| 59256 | 9/1982 | (EP) . |
| 83511 | 7/1983 | (EP) . |
| 380199 | 8/1990 | (EP) . |
| 443722 | 8/1991 | (EP) . |
| 546832 * | 6/1993 | (EP) . |
| 57-100081 | 6/1982 | (JP) . |
| 59-194854 | 11/1984 | (JP) . |
| 60-204331 | 10/1985 | (JP) . |
| 61-20752 | 1/1986 | (JP) . |

* cited by examiner

*Primary Examiner*—N. Le
*Assistant Examiner*—Michael Nghiem
(74) *Attorney, Agent, or Firm*—Fitzpatrick, Cella, Harper & Scinto

(57) ABSTRACT

An ink container connectable with an ink inlet portion of an ink jet head having a plurality of ink ejection outlets, having an improvement in which a surface of the ink container to be connected with the ink jet head is inclined from a plane perpendicular to a direction in which the ink container is connected with the ink supply portion.

2 Claims, 23 Drawing Sheets

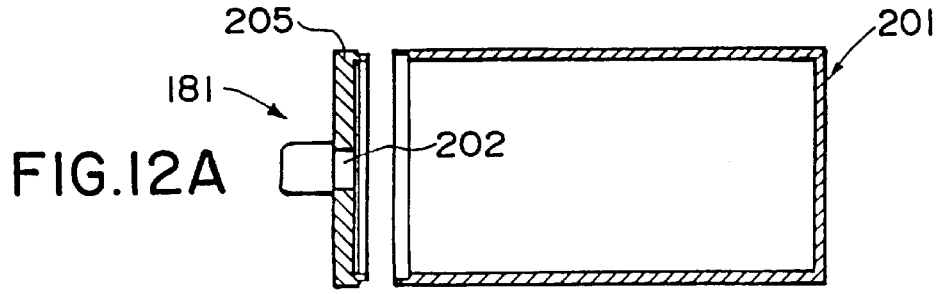
FIG.12A
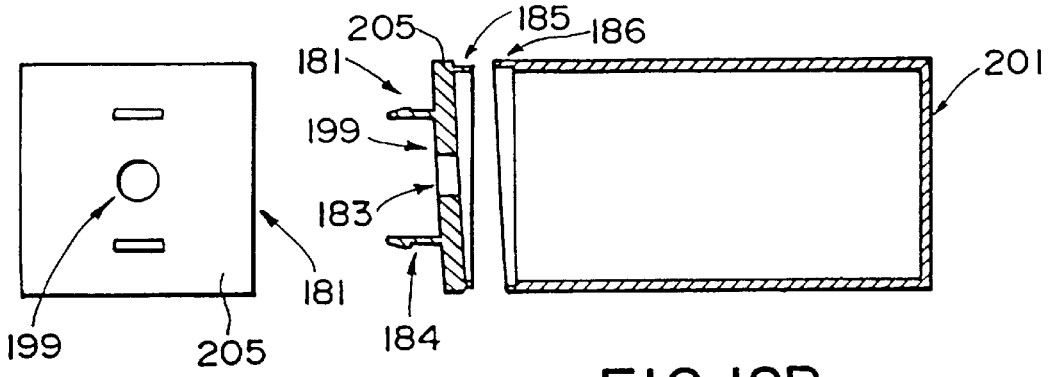
FIG.12C
FIG.12B
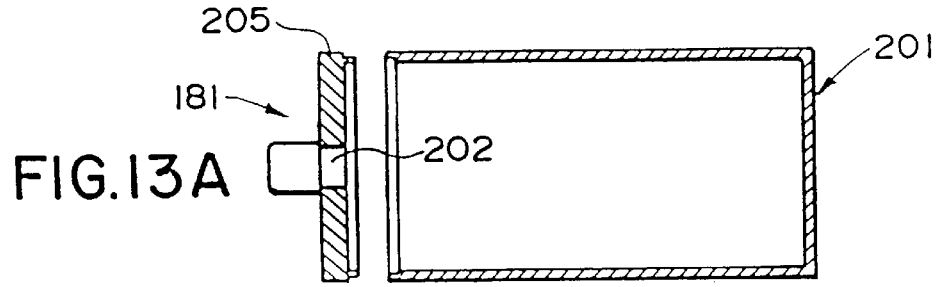
FIG.13A
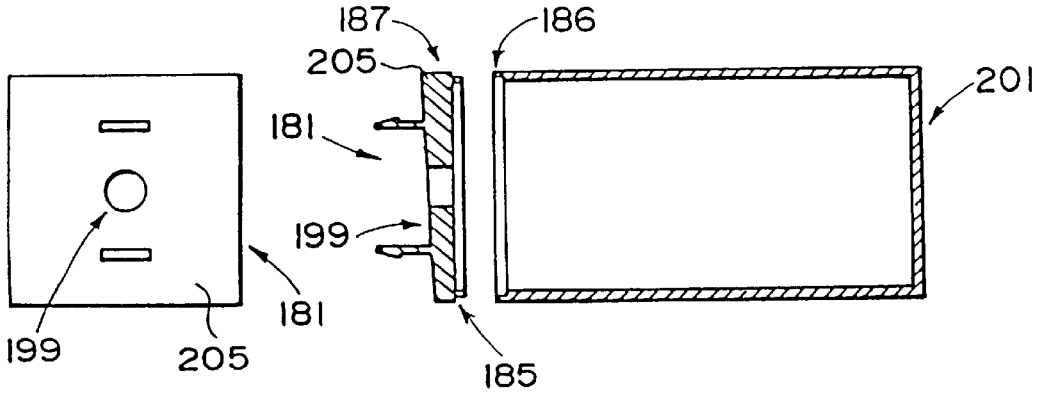
FIG.13C
FIG.13B

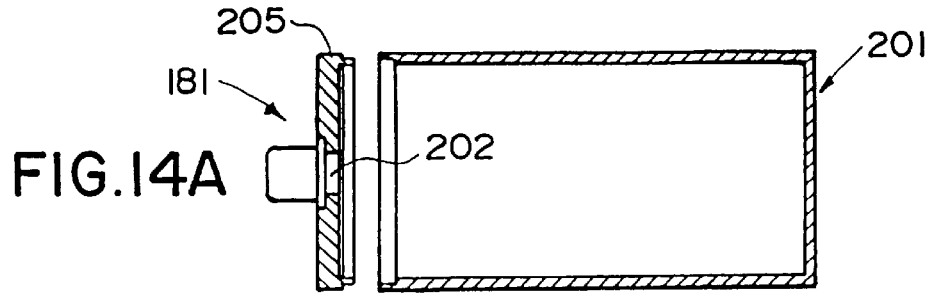
FIG.14A
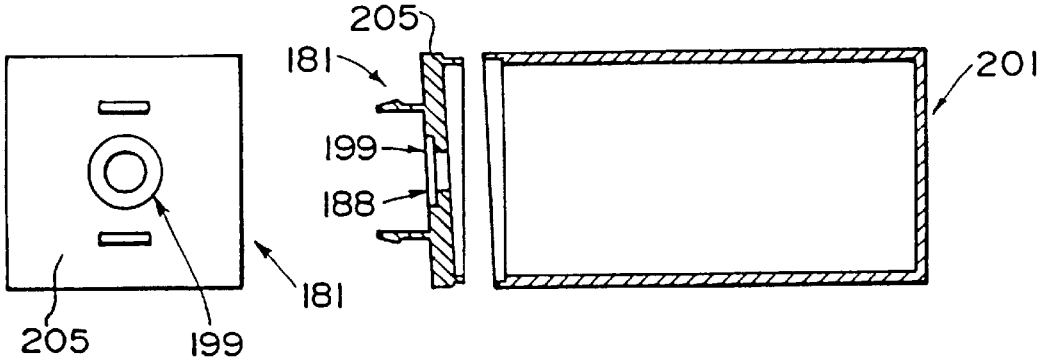
FIG. 14C
FIG. 14B
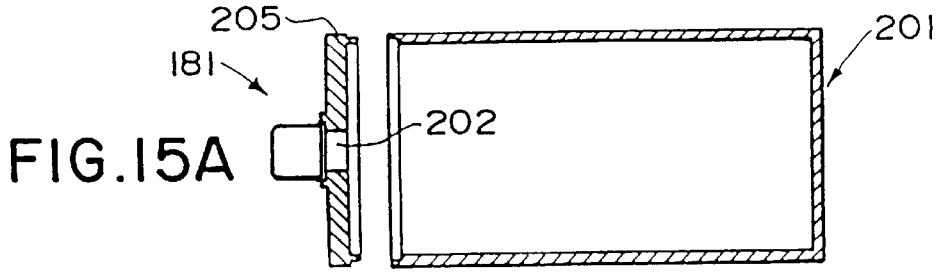
FIG.15A
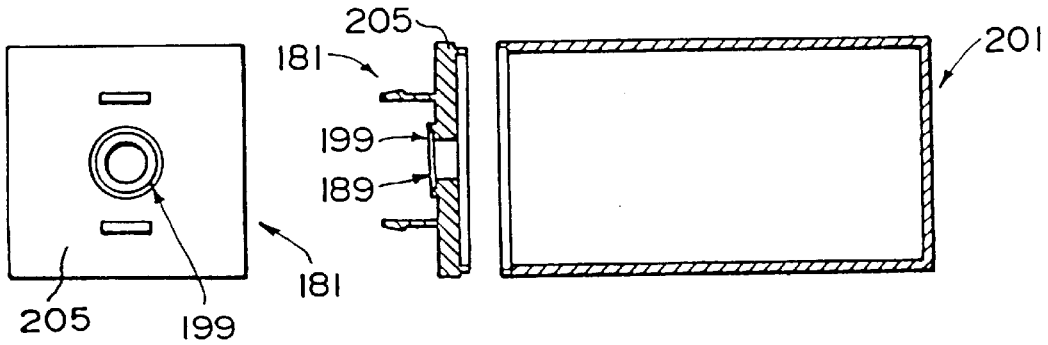
FIG. 15C
FIG. 15B

INK JET CARTRIDGE, INK JET APPARATUS AND INK CONTAINER

This application is a division of Application Ser. No. 08/631,033, filed Apr. 18, 1996, now U.S. Pat. No. 5,940, 102, which was a continuation of Application Ser. No. 08/181,180 filed Jan. 13, 1994, abandoned.

FIELD OF THE INVENTION AND RELATED ART

The present invention relates to an ink jet cartridge, an ink jet apparatus and an ink container, more particularly to an ink jet head detachably mountable on an ink jet apparatus and detachably mountable relative to an ink container, a small size ink jet cartridge using the same, and an ink jet apparatus usable with the ink jet cartridge.

Recently, various types of recording systems have been developed. Among them, an ink jet recording system in which ink is ejected through an ejection outlet in accordance with a recording signal, is widely used because the size reduction and the noise reduction are easily accomplished.

The ink jet recording apparatus are classified into a serial type recording system in which a recording head provided with a plurality of nozzles is mounted on a carriage, and the ink is ejected through the nozzles while the carriage is moved in a direction substantially perpendicular to the recording sheet feeding direction, and a line type recording system in which a recording head having a plurality of nozzles arranged in a direction substantially perpendicular to the recording sheet feeding direction, and the ink is ejected through the nozzles while the recording sheet is being fed. Because of the recent demand for the small size apparatus, the serial type apparatus is widely used. As for the driving method in these recording systems, it is avoided that the ink is ejected simultaneously through a plurality of nozzles because of the necessity for supplying the consumed amount df the ink to the recording head and in order to avoid the supply of large electric current to the recording head as a result of the simultaneous driving of the nozzles. More particularly, the ejection timing is deviated for each nozzles, or the nozzles are grouped into a plurality of blocks, and the driving timing is deviated for the respective blocks. However, in the above-described serial type recording system, the carriage carrying the ink jet head is moved, or the recording sheet is fed, while the ink is ejected through the nozzles, and therefore, when the block driving system is used, the deviation of the ejection timing appears as the deviation of the record positions.

In the prior art, when the driving signals are applied to the nozzles #1–#m at the timing shown in FIG. 26B, the respective nozzles are arranged such that the nozzle array is inclined by $d=V\times tm$, where tm is the amount of deviation in the ejection timing, and $V=R/t$ cycle is a feeding speed of the carriage. By doing so, the deviation (d in FIG. 26A) in the above-described recording operation, is corrected to accomplish the recording shown in FIG. 27.

FIGS. 28A and 28B are schematic views of an example of an ink jet cartridge as seen from the nozzle, on the carriage when the nozzle array is inclined by a predetermined angle from a direction perpendicular to the scanning direction (X1, X2).

In FIG. 28A, an ink jet cartridge in the form of a recording head 200 having an array of ejection outlets 5, and an ink container 201 combined therewith, is carried on a carriage 203. In this Figure, the scanning direction of the carriage 203 (X1, X2) is a longitudinal direction of the carriage 201.

However, the ink jet cartridge on the carriage 203 is inclined relative to the scanning direction of the carriage 203, as shown in the Figure, by which the array of the ejection outlets (nozzle array) is inclined by a predetermined degree.

On the other hand, in FIG. 28B, the position of the ink jet cartridge on the carriage 203 is the same as the longitudinal direction of the carriage, but the longitudinal direction of the carriage 203 is different from the carriage scanning direction, by which the ejection outlet array is inclined by a predetermined amount. In FIGS. 28A and 28B, Xa designates a direction in which the recording head and the ink container are separated or combined. FIG. 28C, shows this inclination of the nozzle array of the recording head shown in FIGS. 28A and 28B as seen from behind the recording head. The direction of the nozzle array is inclined by θ from a perpendicular direction relative to the carriage moving direction X1, X2, and the mounting and demounting direction Xa between the recording head and the ink container, is inclined by θ.

If the mounting and demounting direction between the recording head and the ink container, is inclined by θ relative to the carriage movement direction, the lateral expansion of the recording head and the ink container in the direction of the carriage movement, is increased by $L\sin\theta$, where L is the total length of the recording head and the ink container.

For example, when L=60 mm, and θ=1 degree, the increase is approx. 1 mm. Accordingly, the above-described arranged gives rise to the difficulty in reducing the size of the carriage and/or the size of the recording apparatus. In a recent small size ink jet apparatus, an ink jet cartridge is provided in which the ink jet head and the ink container are separable from each other to permit replacement of the ink container in consideration of the larger length of the service life of the ink jet head. In such a system in which the ink jet head and the ink container are separable, an additional space is required to permit the junction or separation between the ink jet head and the ink container, in the apparatus. Therefore, the shown system involves the difficulty in reducing the size of the apparatus.

On the other hand, as a method of connecting a replaceable ink container to an ink jet recording head, there is a method in which an ink container plugged with elastic member such as rubber member, is pierced with a needle integral with a pipe to establish an ink passage to the ink jet recording head. In this case, the ink is contained in a bladder made of polymer or the like in the ink container. However, this method involves a drawback that a required volume is large because of the length of the needle and the existence of the plug of the ink container, and therefore, it is not suitable in view of the recent demand for the size reduction.

With the tendency of the small size apparatus, the apparatus is more frequently carried around, and in view of the fact, the stabilized retention of the ink in the container in the apparatus is highly desired. So, a high polymer porous absorbing material is preferably used as an ink accommodating material, in the container. However, in this case, it becomes difficult to supply the ink to the recording head using the above-described needle.

The reason is as follows. A gap in communication with the external ambience is formed around the needle with the result that the air is sucked through the gap despite the amount of the ink remaining in the absorbing material is sufficient. This may lead to failure of the ink jet apparatus. In order to avoid this problem, as shown in FIG. 29, a method will be considered in which the porous material containing the ink is press-contacted to the needle. However, in this case, it becomes difficult to supply the ink to the recording head using the needle. This is because a gap communicating with external ambience is formed around the needle so that the air is sucked through the gap despite a sufficient amount of the ink remains in the absorbing material. If this occurs, the printing operation becomes not possible, as the case may be.

It would be considered in order to avoid this problem that an ink inlet portion 208 of the recording head is press-contacted to the porous absorbing material containing the ink. In this case, the hermetical sealing to the prevent introduction of the air into the ink passage through the connecting portion between the recording head and the ink container, is required. In order to provide a solution to this problem, it would be required that an O-ring 206 is provided on the circumferential periphery of the connecting pipe to provide the hermetical sealing between the recording head and the ink container. In this system, the O-ring is already mounted on the recording head in the plant, and therefore, when a user connects the ink container to a new recording head, the air may be introduced between the recording head and the ink container, or on the contrary, the ink is leaked out.

The causes for this, have been investigated, and it has been found that upon the connection of the ink container, the O-ring does not smoothly slide on the ink inlet portion of the recording head by the connecting surface of the ink container with the result of deformation of the O-ring. When this occurs, the gap is produced between the connecting surface of the ink container and the connecting surface of the recording head. This trouble does not always occurs, and the frequency is not so high. However, the frequency is increased depending on the variation of the dimension of the recording head and the variation in the dimension of the O-ring. If the elastic member constituting O-ring is kept being stressed, it may stick to the ink supply portion of the recording head, so that the above-described problem is increased. In such a case, even if the ink container is moved in the mounting or demounting direction, the O-ring does not slides easily with the result of twisting, even to such an extent that the O-ring is damaged or torn.

Therefore, when the ink container is connected for the first time after the manufacturing, it is desirable that the force is applied in a direction perpendicular to the sliding surface with the O-ring, that is, in the direction away from the sliding surface. On the other hand, in the case of the recording head with which the ink containers have been replaced a number of times, the ink connecting portion is wetted with the ink in many cases. Therefore, the friction between the O-ring and the ink supply portion, is very small, so that hardly any trouble occurs.

However, when the ink container is to be taken out, the O-ring may be slightly raised from the connecting surface of the recording head because of the small friction. If the apparatus is left with this state, the ink may be dried, and the similar problem arises when a new ink container is connected.

SUMMARY OF THE INVENTION

Accordingly, it is a principal object of the present invention to provide an ink container, an ink jet head and an ink jet cartridge using the same in which when the nozzle array is inclined by a predetermined degree, the operativity is satisfactory, and the size is small.

It is another object of the present invention to provide an ink container, ink jet head and an ink jet cartridge of an ink container detachable type, in which the ink container and the ink jet head are securedly connected, and it is effectively avoided that the air is introduced into the ink passage through the connecting portion and that the ink leaks out through the ink passage.

According to an aspect of the present invention, the mounting and demounting direction of the ink container is in accord with the carriage feeding direction even if a direction in which the plurality of ejection outlets are arranged is inclined relative to the mounting and demounting direction between the ink jet head and the ink container. By doing so, even if the nozzle array is inclined from the perpendicular direction relative to the carriage feeding direction, the width in the direction perpendicular to the carriage feeding direction when the recording head and the ink container are connected with each other, can be minimized, and therefore, the size of the ink jet recording apparatus can be reduced.

The surface of the recording head and the surface of the ink container at the connecting portion between them, are inclined relative to a plain perpendicular to the mounting and demounting direction between the recording head and the ink container. By doing so, even if the ink container is connected for the fist time after the manufacturing of the apparatus, a part of the O-ring is first urged to the inclined connecting surface of the ink container, thus permitting smooth motion.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIGS. 12A, 12B and 12C show an ink container according to an embodiment of the present invention.

FIGS. 13A, 13B, 13C, 14A, 14B, 14C, 15A, 15B, 15C, 16A, 16B, 16C, 16D, 17A, 17B, 17C, and 17D show ink containers according to other embodiments of the present invention.

DESCRIPTION OF THE PREFERRED EMBODIMENTS

Referring to the accompanying drawings, the embodiments of the present invention will be described in detail.

First, the description will be made as to an ink jet apparatus using an ink jet cartridge in which the ink container and the ink jet head are integral.

Referring to the accompanying drawings, the embodiments of the present invention will be described in detail.

Figure 1:
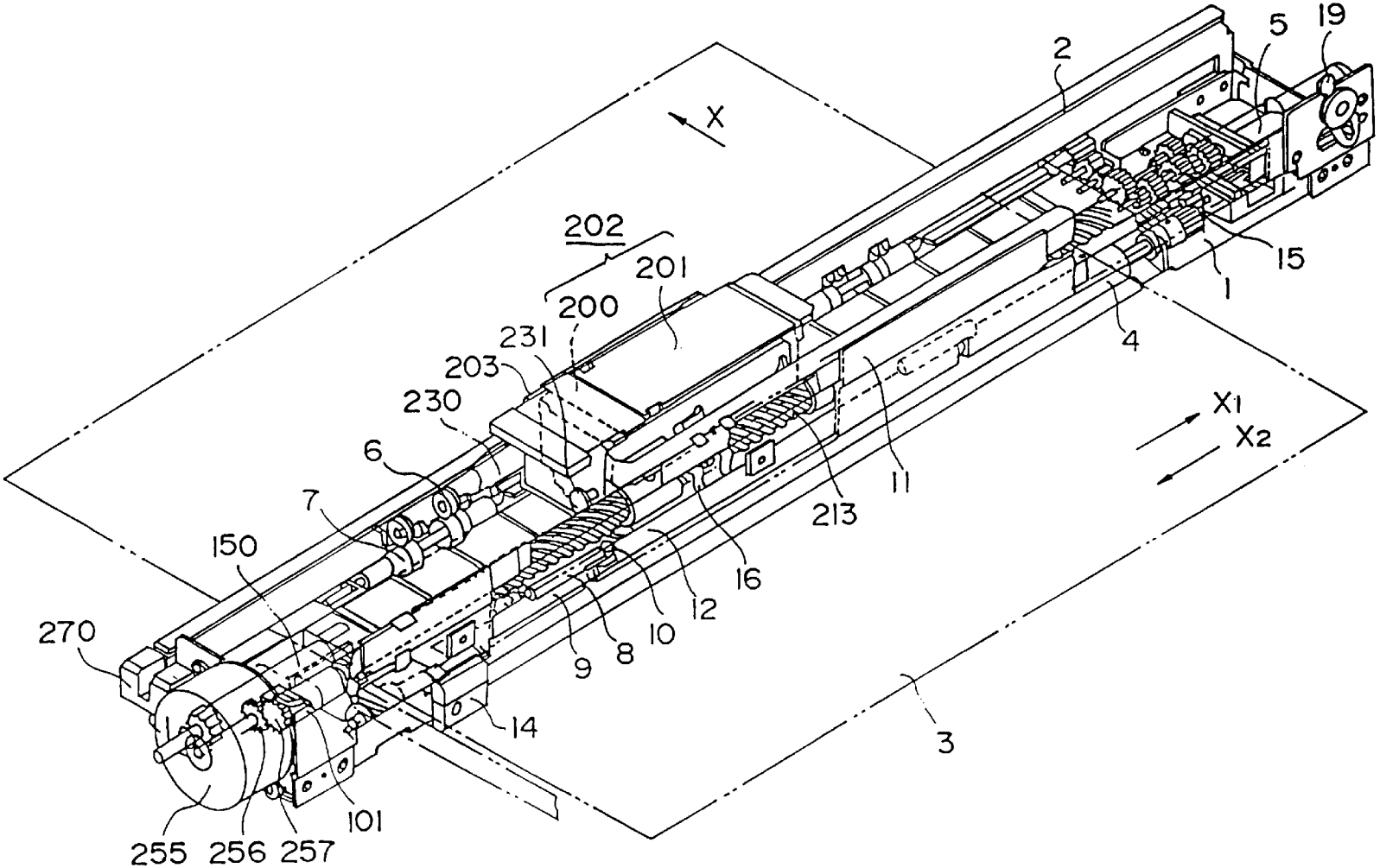
FIG. 1 is a schematic perspective view of an ink jet recording apparatus according to an embodiment of the present invention.

Referring to FIG. 1, there is shown a recording apparatus according to an embodiment of the present invention, in the perspective view. In the figure, a reference numeral 203 designates a carriage for carrying thereon a recording head cartridge 202 having a recording head 200 constituting the recording means and an ink container 202 integral with recording head 200. An end of the carriage 203 adjacent the recording head 200 is engaged with a lead screw 213 for sliding movement in the axial direction, the lead screw 13 being rotatably mounted in a frame 1. The carriage 203 is provided with a guide at another end, and the guide is engaged with a guide rail 2 in the frame 1 for sliding movement in the direction parallel to the axis of the lead crew 213. The carriage 203 is reciprocable in the axial direction with rotation of the lead crew 13, while the pose thereof is maintained constant.

As shown in the figure, a lead screw gear 257 fixed to the left end of the screw and a pinion gear 256 fixed to an output shaft of the carriage motor 255, are in meshing engagement, and a lead screw pin 209 mounted to the carriage 203 is engaged in a guide groove 268 helically formed at a predetermined pitch on the lead screw 213. Therefore, when the lead screw 213 rotates by the forward or backward rotation of the carriage motor 255, the carriage 203 reciprocates. The detail of the scanning operation of the carriage 203 will be described in detail hereinafter.

A flexible cable transmits the printing signal to the recording head 200 from electric circuit which will be described hereinafter. It is supported on a pinch roller frame 11 at a predetermined position by a flexible cable holder 16.

The recording head 203 is moved in synchronism with the reciprocal movement of the carriage 203, and the ink is ejected in accordance with the recording signal, thus effecting recording on the recording material 3 in one line. The recording head 200 comprises fine liquid ejection outlets (orifice), liquid passages, energy application portions in the parts of the liquid passages, and energy generating means for generating energy for formation of liquid droplet.

As for the energy generating means, there are electromechanical transducer element such as a piezoelectric element, electromagnetic wave such as laser to produce heat to eject the liquid, and electrothermal transducer element in the form of a heat generating resistor or the like to heat the liquid to eject it.

Among them, in a recording head of ink jet recording type in which the liquid is ejected using thermal energy, the liquid ejection outlets for formation of the droplets of the liquid can be arranged at high density, and therefore, a high resolution recording is possible. Particularly, the recording head using the electrothermal transducer element as the energy generating means, can be easily reduced in the size. In addition, the advantages of IC manufacturing techniques and micromachining techniques which are recently significantly developed and which are recently reliable, can be used, and therefore, high density arrangement is possible with the advantage of low manufacturing cost.

When one line recording is completed by the scan of the carriage 203, the recording material 3 is fed by one line by feeding means, and the next line recording operation is carried out. The feeding of the recording material 3 is accomplished by a pair of feeding roller 4 and a pinch roller 8 press-contacted thereto, and a pair of discharging roller 7 and spurs 6 contacted thereto.

More particularly, the recording material 3 having a recording surface faced to the ejection side surface of the recording head 200 is press-contacted to the feeding roller 4 by the pinch roller 8, and the feeding roller 4 is rotated by a sheet feed motor 5, by which the recording material 3 is fed through a proper distance. After the recording operation, the recording material is press-contacted to the discharging roller 7 by the spurs 6, and the recording material is discharged to the outside of the apparatus by the rotation of the discharging roller 7.

The feeding roller 4 and the discharging roller 7 are driven by the feeding motor 5 through a reduction gear train 15.

A paper sensor 14 functions to detect presence or absence of the recording material 3. A reference numeral 270 designates a home position sensor, which detects whether the carrier 203 is back at the home position (left side in the figure) before the recording is started.

Designated by a reference numeral 270 is a home position sensor which detects the resetting of the carriage 203 at the home position (left side in Figure), before the start of the recording operation.

Figure 2:
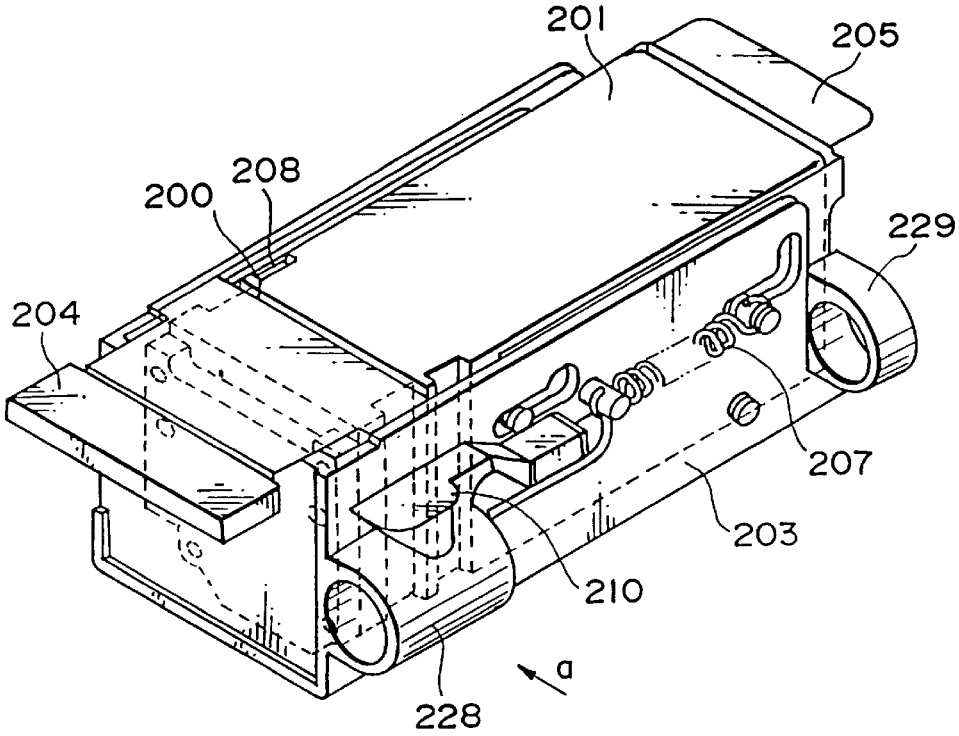
FIG. 2 is a schematic perspective view of a carriage used in the ink jet recording apparatus shown in FIG. 1.

FIG. 2 is a perspective view of the head cartridge and the carriage of the recording apparatus according to this embodiment of the present invention. In this figure, reference numeral 200 designates a recording head for ejecting the ink in accordance with electric signal; 201, an ink container for containing the ink to be supplied to the recording head; 203, a carriage in the main assembly of the apparatus effective to carry the recording head 200 and the ink container 201; 204, a head lever for supporting and releasing the recording head; 205, an ink container lever for detachably mounting the ink container 201; 207, a head holder spring for fixing the recording head 200 to the carriage 203; 208, a container case for supporting the ink container 201. By these elements, the head cartridge and the carriage are constituted.

The recording head 200 comprises a base plate having a plurality of electrothermal transducer elements for producing thermal energy used for ink ejection and driving circuit for driving them, a top plate for forming ejection outlets and liquid passages corresponding to the respective electrothermal transducer elements and for forming a common liquid chamber communicating with the liquid passage, and electric contacts for supplying electric signals from the main assembly to the driving circuit. The recording head 200 may be provided with sensors for permitting the main assembly of the recording apparatus to detect the states of the recording head. More particularly, the sensors include a temperature sensor for detecting the temperature of the recording head in the neighborhood of the electrothermal transducer elements, ink sensor for detecting a remaining amount of the ink in common liquid chamber, and head identification sensor for identification of types of the head cartridge when different types of heads are exchangeably usable. The signals from the sensors are discriminated by the main assembly of the recording apparatus, and the signals applied to the electrothermal transducer elements are controlled, accordingly, thus providing the optimum printing conditions.

The ejection side surface having the ejection outlets of the recording head is faced to the recording material in the recording apparatus.

The description will be made as to the mechanical and electrical connection between the recording head 200 and carriage 203.

Figure 3:
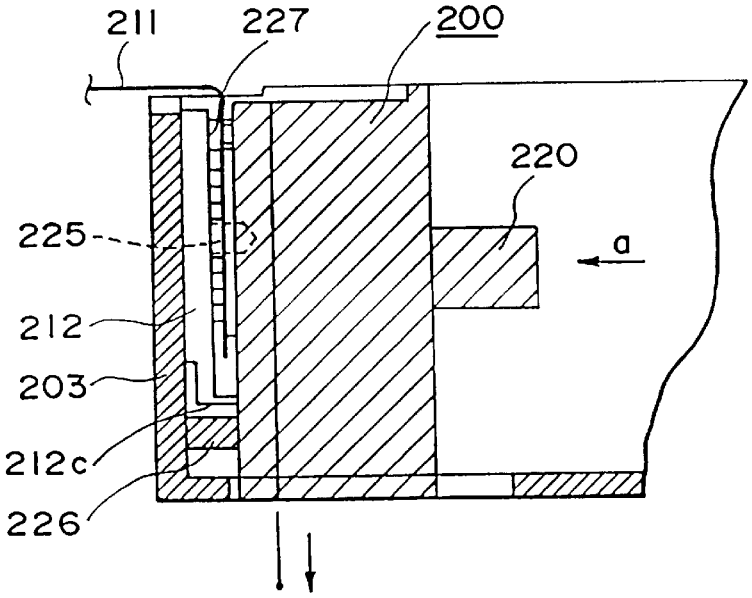
FIG. 3 is an enlarged schematic perspective view of the carriage according to the embodiment of the present invention.
Figure 4:
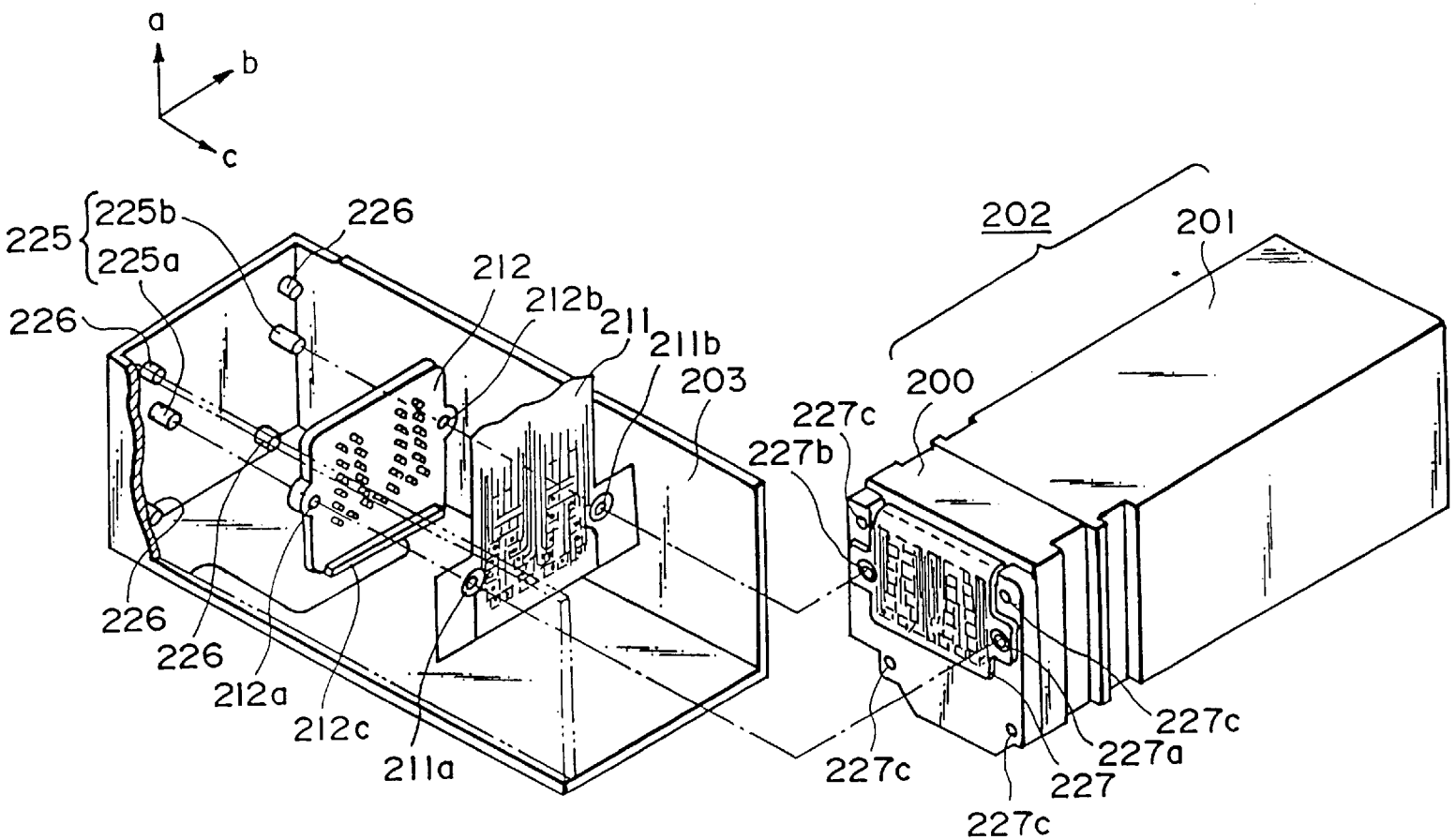
FIG. 4 is a schematic perspective view illustrating the connection between the carriage and the head cartridge in the ink jet recording apparatus according to the embodiment.

FIG. 3 is a sectional view taken along a line a in FIG. 2, illustrating the connection between the carriage 203 and recording head 200. FIG. 4 is a perspective view illustrating the process. In the Figures, reference numeral 225 designates positioning pins engageable with corresponding holes of a recording head on the carriage 203 to accurately position the recording head 200 in a direction a and a direction b in FIG. 4; 226 designates a stopper fixed on the carriage 203 to stop the recording head 200 urged in the direction a in FIG. 3; 211 is a flexible cable for electrically connecting the recording head 200 and the main assembly of the recording apparatus; 211*a*, a positioning hole in the flexible cable 211; 211*b*, a positioning hole in the flexible cable 211; and 212, a flexible cable pad elastically supporting the flexible cable 211 and sandwiched between the flexible cable 211 and the carriage 203. In addition, reference numeral 212*a* designates a positioning hole in the flexible cable pad 212; 212*b*, a positioning hole in the flexible cable pad 212; 212*c*, an ink barrier for preventing ink entrance to the contact position; 222, a head contact portion electrically connected with the heater in the recording head 200; 227*a*, a positioning hole in the head contact 227; 227*b*, a positioning hole in the head contact portion 227; and 227*c*, a'stopper abutment for abutting with the end surface of the stopper 226.

The recording head 200 is urged in the direction a through an unshown lever by the head holder spring 207. The position thereof is definitely determined by the engagement between the hole of the recording head 200 and the positioning pin 225 and by the interference with the stopper 226. In this manner, the recording head 200 and the carriage 203 are mechanically connected.

On the end surfaces of the head contact portion 227 of the recording head 200 and the flexible cable 211, there are provided corresponding plural electric contacts. They are pressed to each other with a predetermined pressure, so that the main assembly of the recording apparatus and the recording head 200 are electrically connected. It is necessary that the respective contacts are pressed at once. For the purpose of uniform pressing, there is provided a flexible cable pad 212 of elastic material. The material of the flexible cable pad 212 is of silicone rubber. It comprises plural projections at positions corresponding to the electric contacts to concentrate the pressure on the contact points. The electric contacts of the flexible cable 211 may be in the form of projection sin order to further assure the pressure concentrated on the contact points.

Since the reaction force produced upon the pressing is designed to be far smaller than the force of the head holder spring 207 for urging the recording head 200, and therefore, the recording head 200 is prevented from deviation by the reaction force from the flexible cable pad 212.

The carriage 203, the flexible cable pads 212, the flexible cable 211, the head contact portion 227 and the head cartridge 203 are required to be correctly positioned relative to each other in order to assure the electric connection and the high print quality. In order to accomplish this, the following structure is used.

One of the positioning point 225 commonly engages with the positioning hole 212*a*, the positioning hole 211*a* and positioning hole 227*a*, and the other positioning pins 225 commonly engages with the positioning hole 212*b*, the positioning hole 227*b*, by which the positioning in the directions a and b in FIG. 4 are accomplished.

In this embodiment, stoppers 226 are provided, being inclined by relative to the directions X1 and X2 in which the carrier 203 is moved. As for the nozzles #1–#m of the recording head 200, they are aligned with a predetermined pitch of P and also, in such a manner so that the nozzle alignment line is inclined to give the nozzle #m a deviation of d relative to the nozzle alignment length of H. Further, in order to assure precisely the predetermined amount of d, a distance G between the stoppers 226 is established to be larger relative to the nozzle alignment length.

The description will be made as to an ink jet head, an ink container and an ink jet cartridge according to an embodiment of the present invention.

Figure 6A:
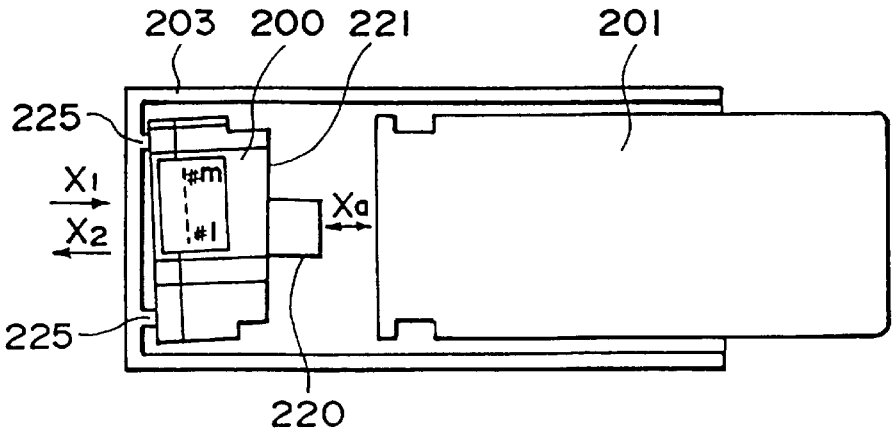
FIGS. 6A, 6B and 6C are schematic views illustrating the mounting and demounting directions among the carriage, the recording head and the ink container in the ink jet recording apparatus according to the embodiment of the present invention.
Figure 6B:
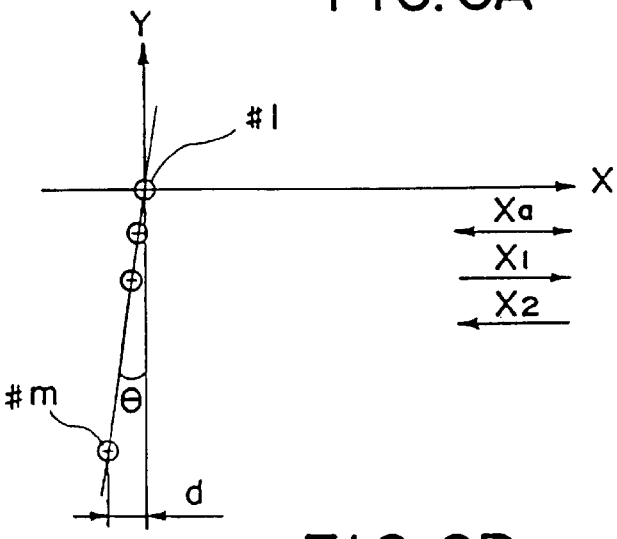
Figure 6C:
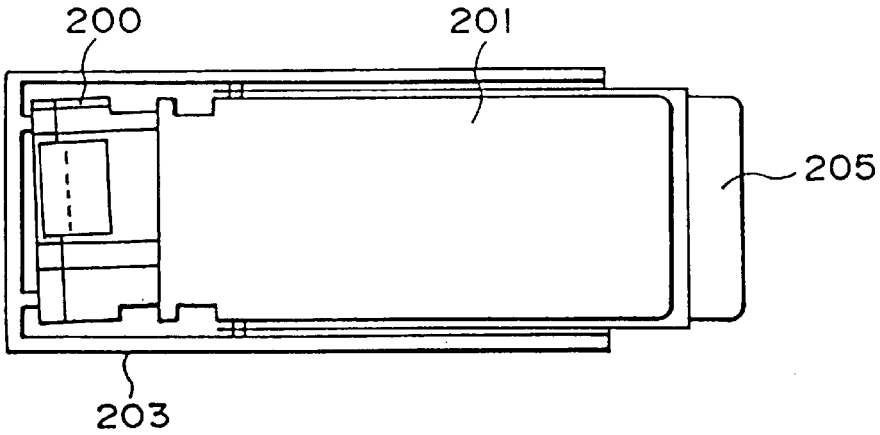

FIGS. 6A and 6C is a schematic view of the ink jet head 200 and the ink container 201, as seen from the ink ejection side, illustrating the connecting relation between them. FIG. 6A shows a state in which the recording head 200 and the ink container 201 are mounted on the carriage 203 movable in directions X1 and X2. The recording head and the ink container are on the way of connection.

In FIG. 6A, in order to incline the ejection outlets #1–#m, from a direction perpendicular to the carriage movement directions X1 and X2, the recording head 200 per se is inclined in accordance with the positioning portion 225 of the carriage. In this embodiment, even if the recording head is inclined, the ink inlet portion 220 is in accord with the carriage movement direction (longitudinal direction of the carriage in this embodiment) so that the direction of connection with the ink container is substantially in accord with the movement direction of the carriage. The connecting surface 221 with the ink container is inclined so that it is perpendicular to the carriage movement direction (the longitudinal direction of the carriage).

The junction or connection surface 221 of the recording head relative to the ink container, is not necessarily in contact with each other, and is inclined relative to the ejection outlet array. The ink supply portion 220 is inclined from a direction perpendicular to the array of the ejection outlets.

FIG. 6B is a plan view illustrating the inclined relation in various directions, as seen from the front side of the recording sheet. The ink container mounting direction Xa is substantially parallel with the carriage movement direction X1 and X2 during the printing operation. The direction of the nozzle array is inclined by angle θ from a direction perpendicular to the ink container mounting (demounting) direction Xa.

In FIG. 6C, the ink container 201 has been connected with the recording head 200.

By disposing the connecting surface 221 inclinedly relative to the array of the ejection outlets, the array can be inclined from the carriage movement direction by a predetermined degree, without size increase of the carriage or the ink jet apparatus or without the influence to the operativity in the engagement or disengagement between the head and the ink container. Therefore, the size reduction of the apparatus and the correct recording can be accomplished, simultaneously.

Figure 7A:
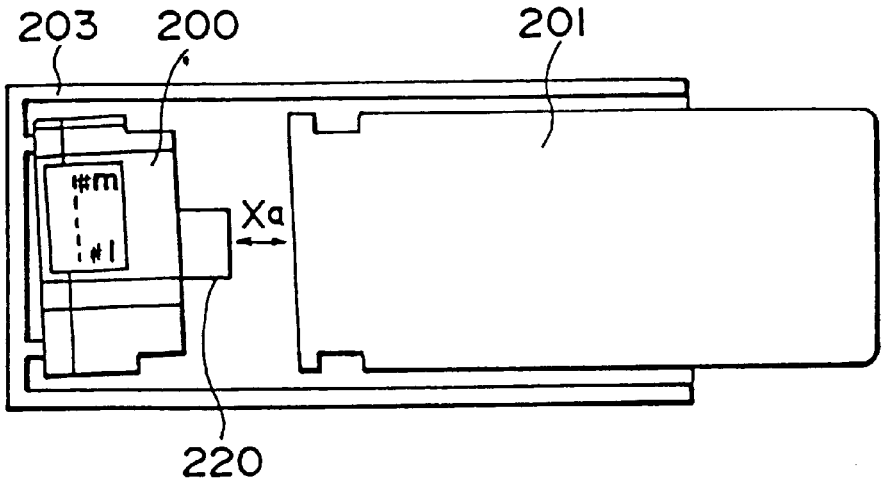
FIGS. 7A and 7B are schematic views illustrating the mounting and demounting directions among the carriage, the recording head and the ink container in an ink jet recording apparatus according to an embodiment of the present invention.
Figure 7B:
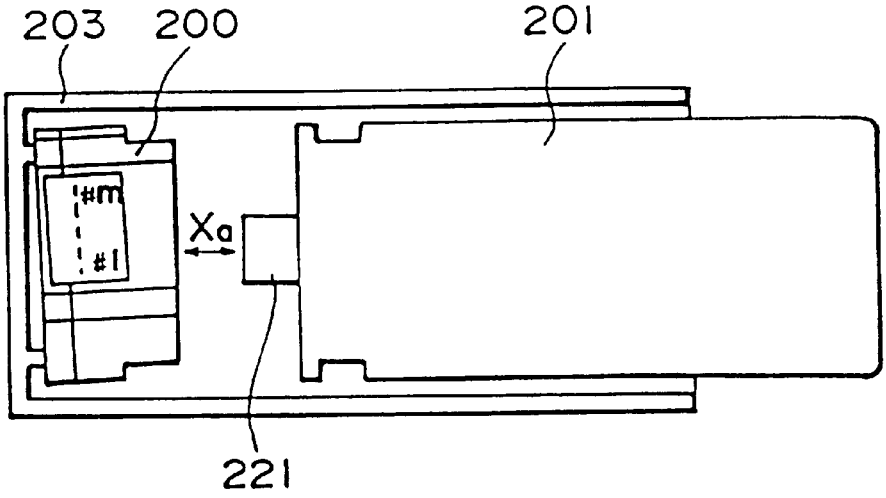

FIGS. 7A and 7B shows another embodiment of the present invention. As shown in FIG. 7A, the connecting plane between the recording head 200 and the ink container 201 is not perpendicular to the mounting or demounting direction Xa. It may be along the nozzle array direction (it is not necessarily completely parallel, if the advantageous effects of the present invention are provided). As described in the foregoing, the same advantageous effects can be provided when the connecting surface of the ink container rather than that of the recording head is inclined.

In the foregoing embodiment, ink inlet portion, is provided on the recording head 200, but it (projection) may be provided in the ink container 201 side, as shown in FIG. 7B.

In the foregoing, the description has been made as to a recording head for monochromatic recording. However, the advantageous effects of the invention, are more significant when a plurality of recording heads and ink containers for different colors, are used.

The description will be made as to the recording method and the inclination of the ejection outlet array, using an ink jet cartridge comprising an ink jet head and an integral ink container.

Figure 8:
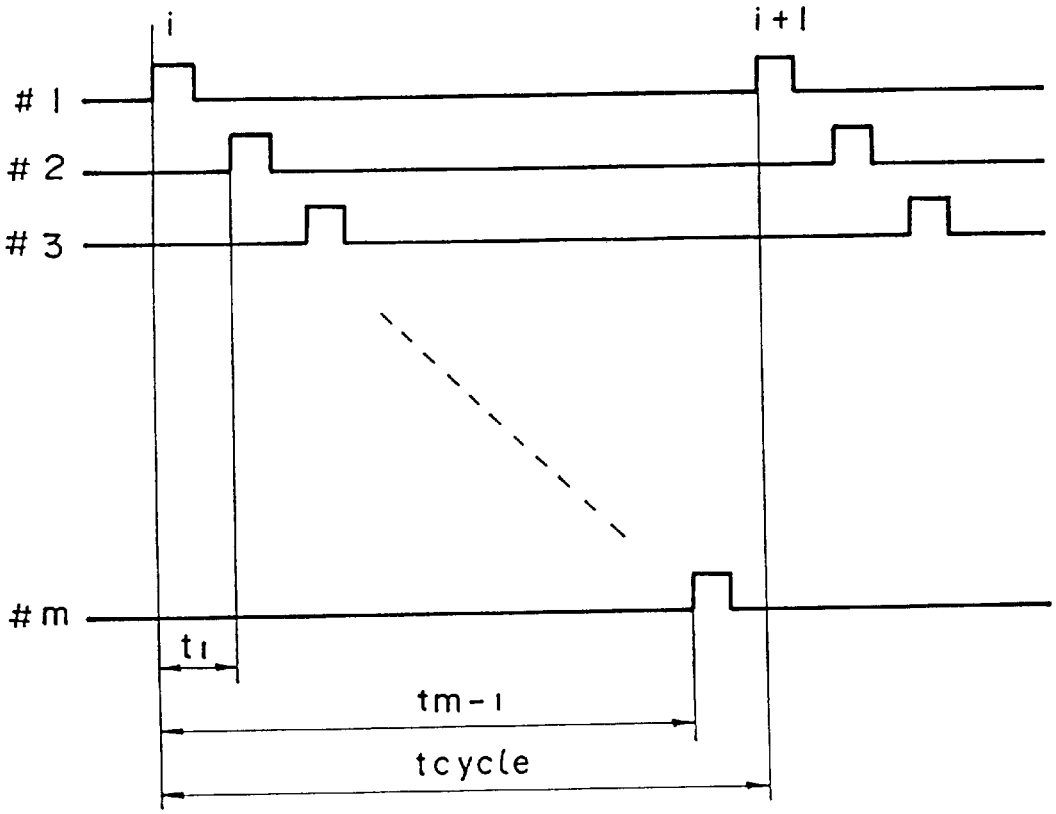
FIG. 8 is a timing chart of ink ejection of the recording head of the first embodiment of the present invention.

Referring to FIG. 8, there is shown the timing of ink ejection of the recording head.

Figure 5:
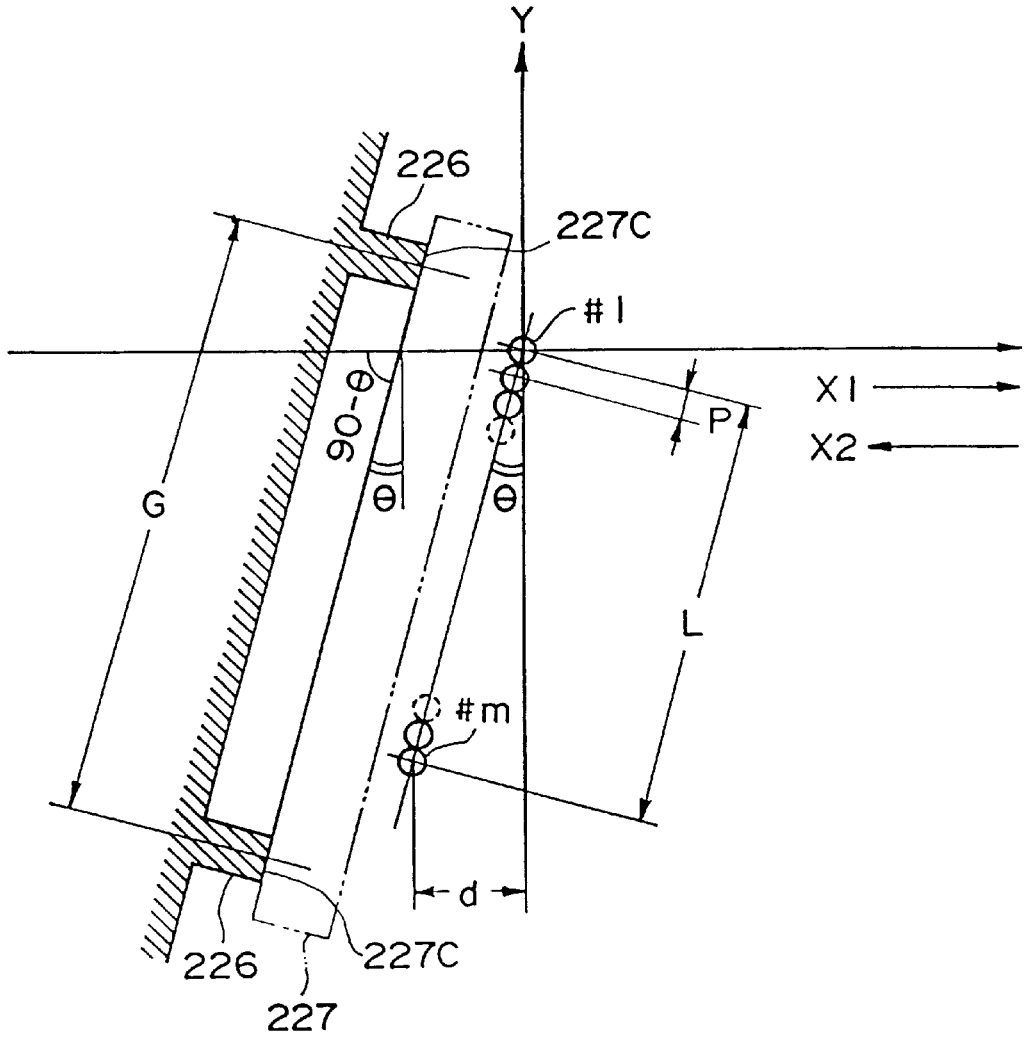
FIG. 5 is a schematic view illustrating the positioning method between the carriage and the head cartridge in an ink jet recording apparatus according to the embodiment.
Figure 9:
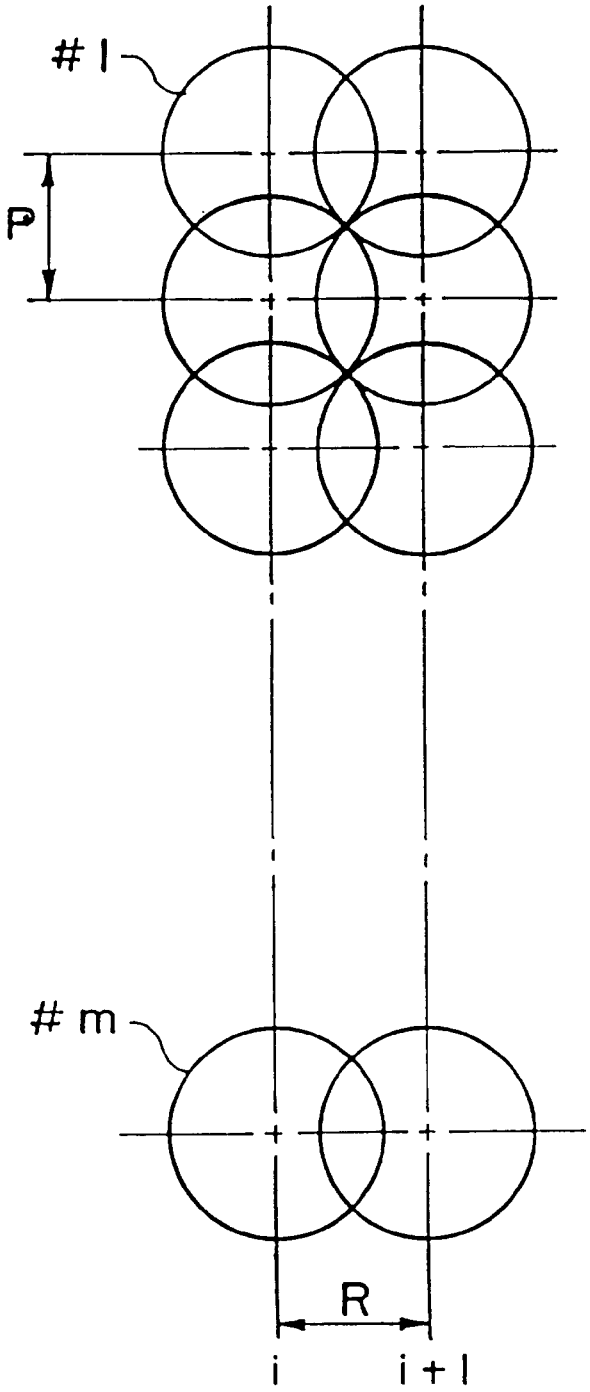
FIG. 9 shows a result of record by an ink jet recording apparatus according to the first embodiment of the present invention.

In FIG. 8, the recording head 200 ejects the ink to accomplish the record shown in FIG. 9, while the carriage 203 is moved in the direction X1 (FIGS. 1 and 5).

The ink is ejected in the order from nozzle #1 to nozzle #m. Ejection time difference between nozzle #1 and #2 is designated by t1; the difference of times of ejections between nozzle #1 and nozzle #m, is indicated by tm−1; and the period of ejections of one nozzle is indicated by cycle. Usually, the time difference between the adjacent nozzle ejections, is preferably constant. Therefore, tm−1=(m−1)× t1. The ink ejecting operations are carried out at tm−1=d× tcycle/R, while the carriage 203 is moved in the direction X1 at a speed R/tcycle. By doing so, the time difference tm−1 of the ink ejection through the nozzles and the inclination d of the nozzle array (FIG. 5) are combined to provide the record without the deviation (inclination), as shown in FIG. 9. When the recording operation is carried out while the carriage 203 is moved in the direction X2, the order of ejections are reversed, that is, from #m to #1.

The degree of the nozzle inclination d is preferably tm−1=tcycle/2−tcycle, from the standpoint of the uniform energy application to the recording head and the ink supply. Therefore, d=R/2−R is preferable. Usually, pitch P of the nozzle is equal to R. In this case, the degree of inclination d is preferably P/2−P.

In the foregoing, the description has been made as to the structure in which the ejection outlet array is inclined without increasing the size of the carriage or without deterioration of the operativity. In an embodiment shown in FIG. 7A, the following problems can be solved.

Figure 10A:
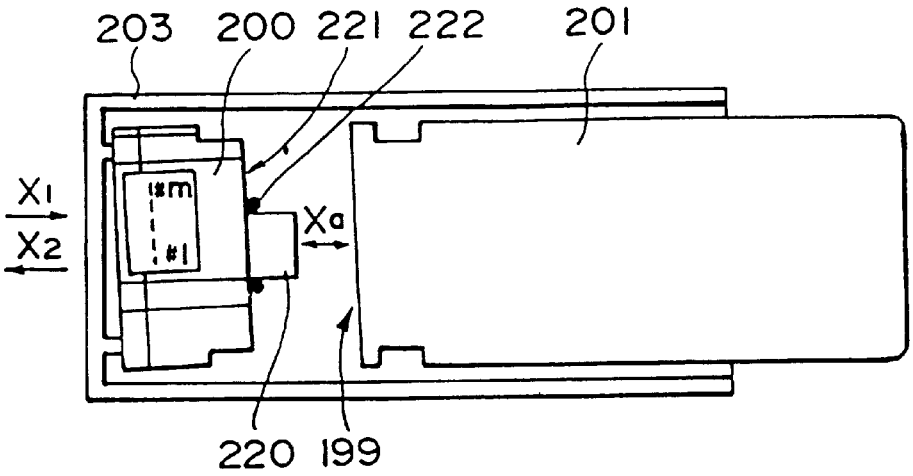
FIGS. 10A and 10B illustrates the mounting and demounting directions among the carriage, the recording head and the ink container in an ink jet recording apparatus according to an embodiment of the present invention.

FIG. 10A shows the state in which the connection between the recording head and the ink container of an ink jet cartridge according to this embodiment, mounted on the carriage, is not completed. It is a view as seen from the ejection outlet side. In this embodiment, in order to increase the sealing between the ink container and the ink jet head, a sealing member (O-ring) 222 in the form of a ring is provided at an ink supply portion of the ink jet head.

The connecting surface of the ink container 201 with the recording head is inclined from a direction perpendicular to the connecting direction between the ink jet head and the ink container.

Figure 10B:
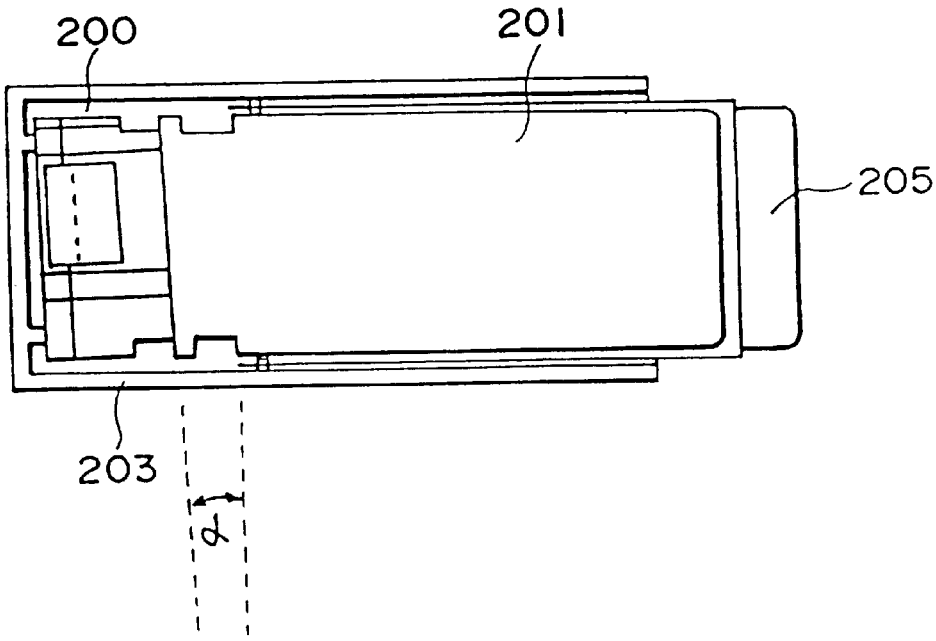
Figure 11A:
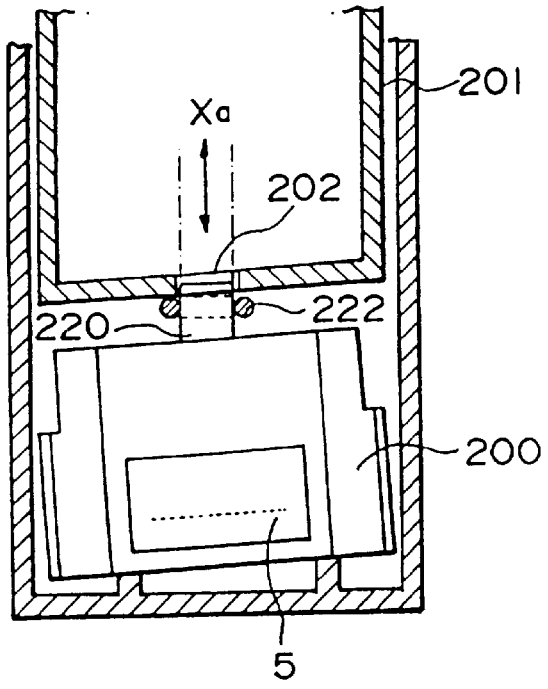
FIGS. 11A and 11B illustrates a relation between an O-ring and an ink container in an embodiment of the present invention.

FIG. 10B shows a relationship between the head cartridge portion and the carriage after the ink container 201 is mounted. In this Figure, the O-ring 222 shown in FIG. 10A, is not seen, because it is behind the recording head and the ink container. In FIG. 11A, the connection is illustrated between the recording head and the ink container shown in FIGS. 10A and 10B. In this Figure, the ink container 201 is on the way of connection relative to the recording head 200, more particularly, at the instance when the connecting surface of the ink container starts to contact the left part of the O-ring 222. In this embodiment, the connecting surface of the ink container is inclined from a direction perpendicular to the connecting direction, relative to the ink inlet portion 220. Therefore, a part of the connecting surface is first brought into contact with a part of the O-ring 222, and applies force thereto.

When the contact portion of the O-ring is first urged by this force, an inside of the O-ring, that is, such a part of the recording head as is contacted to the ink supply portion 222, and the neighborhood thereof, are slightly apart from the contact surface, so that the friction between the O-ring and the surface of the ink inlet portion, is abruptly reduced to permit smooth sliding motion. Particularly when the ink container is first connected with the recording head, all parts are dried , and the elastic member (silicone rubber) constituting the O-ring, is attracted to the ink inlet portion, and therefore, the force effective to urge the O-ring away from the contact surface, is significantly advantageous, even if the force is small. In the case of a recording head with which the ink containers have been exchanged a large number of times, the portion is wetted with the ink in many cases, and therefore, the friction force between the O-ring and the projected side surface, is extremely small. For this reason, hardly any problem arises. However, when the ink container is dismounted, the O-ring may be away from the contact surface of the recording head because of the small friction force, in some cases. If the O-ring is left in this state for a long period of time, the ink is dried, and when the ink container is connected again, the problem described above may arise. For this reason, the advantageous effects provided by moving a part of the O-ring by the connecting surface of the ink container, at first, is significant.

Figure 11B:
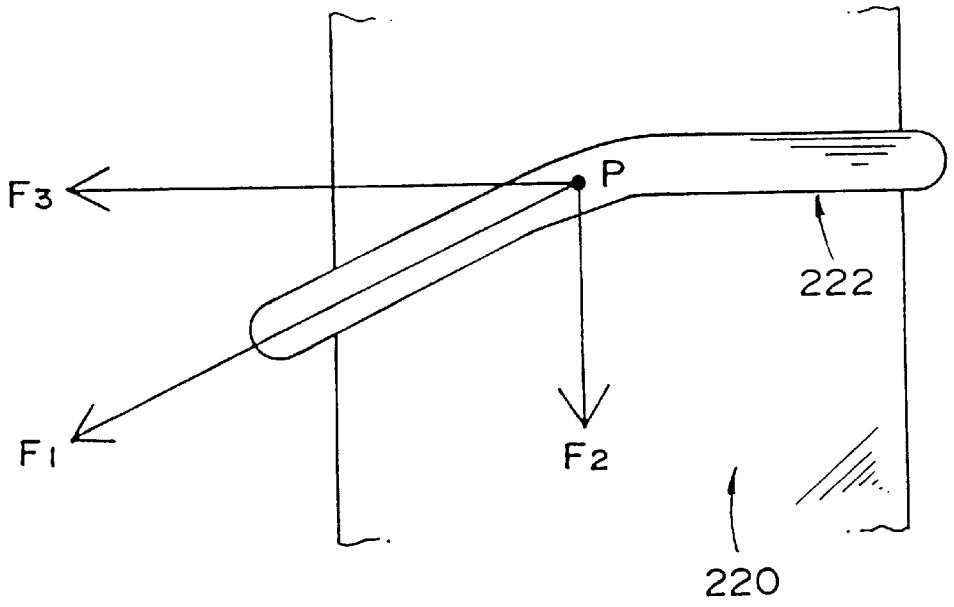

In the case of FIG. 11A, the force tending to separate the O-ring from the sliding surface of the ink supply portion of the recording head (lateral surface) is applied only at the left portion. At the right hand portion, the urging force toward the sliding surface rather than the separating force is applied because of the tension from the left portion. Therefore, it seams that the sliding motion is easy at the left, but it is difficult at the right hand portion. Actually however, once the left side part is separated from the first sliding surface, the motion of the O-ring as an entirety thereof becomes easy. The reason for this is considered as follows. FIG. 11B illustrates this. A part (left part) of the O-ring 222 mounted to the ink inlet portion 220 is deformed by the force applied by the connecting surface of the ink container. In this Figure, the O-ring partly separated from the original position is still stacked on the ink inlet portion 220 at the right hand portion beyond a boundary P. However, the left half has already been separated from the ink supply portion. Therefore, the force produced by being urged to the connecting surface of the ink container, is concentrated only on the point P as a tension F1 along the O-ring. Therefore, the O-ring is easily removed by the component force F2 at the point P. As a result, the boundary P moves to the right. This continuously occurs, and therefore, the O-ring is completely becomes slidable on the ink inlet portion 220, thus permitting the movement thereof to be closely contacted to the connecting surface of the recording head. The inclination angle relative to the surface perpendicular to the ink container mounting and demounting direction, is advantageous when it is about 1 degree, but may be larger. However, if it is too large, the volume efficiency of the ink container is deteriorated.

FIGS. 12A, 12B and 12C shows an ink container according to an embodiment of the present invention. For the sake of simplicity of explanation, the inside structure is omitted in the Figure. FIG. 12A is a lateral sectional view of the ink container, FIG. 12B is a sectional plan view, and FIG. 12C is a view as seen from the connecting surface.

The ink container comprises two members, namely, a cover 205 and a main body 201. The connecting surface is indicated by a reference numeral 199. A hole 183 receives a projection of a recording head into the ink container. A reference numeral 184 designates a claw for engagement with a recording head portion. A sealing portion 185 functions as a sealing portion when the ink supply ports 186 and 202 are connected by ultrasonic fusing or the like. In this example, the cover is connected with the main body with inclination to provide an inclination angle at the connecting surface. The height of the sealing portion 185 is different along the surface of the cover.

FIGS. 13A, 13B and 13C show an ink container according to another embodiment. In FIGS. 12A and 12B, the thickness of the cover is constant. In this embodiment, however, the thickness of the cover 205 is changed to provide the inclination angle at the connecting surface 199. In this embodiment, the height of the sealing portion 185 is constant along the circumference.

FIGS. 14A, 14B and 14C shows an ink container according to a further embodiment. This embodiment is similar to that of FIGS. 12A 12B and 12C, but a recess 188 is formed around the hole 189, and therefore, the connecting surface 199 is provided by the bottom of the recess.

FIGS. 15A, 15B and 15C show another example of the ink container, in which only the engaging hole 189 of the connecting surface of the ink container is inclined. In this structure, the difficulty of motion of the O-ring can be avoided even in the ink container of FIGS. 6A, 6B, and 6C.

Figure 16A:
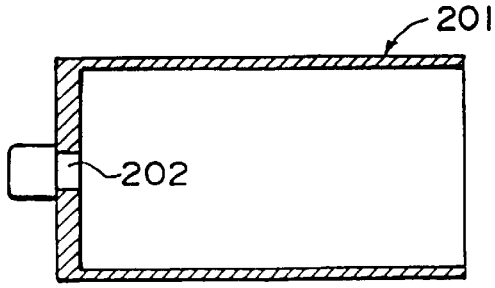
Figure 16C:
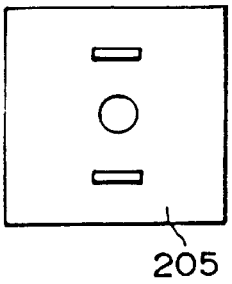
Figure 16B:
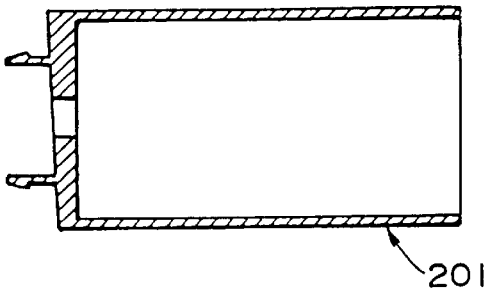
Figure 16D:
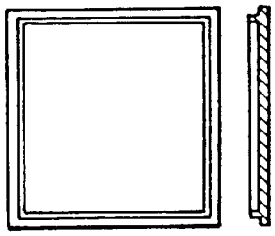
Figure 17A:
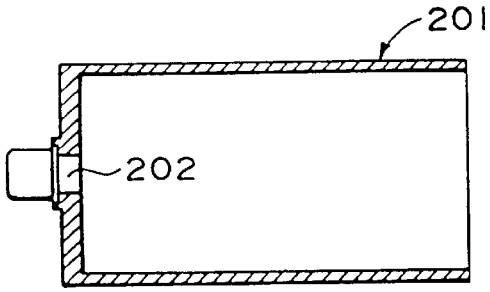
Figure 17C:
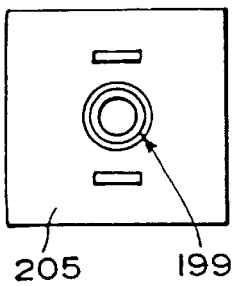
Figure 17B:
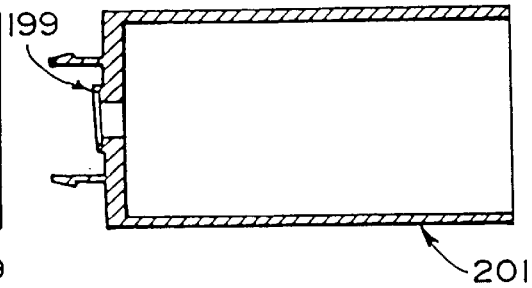
Figure 17D:
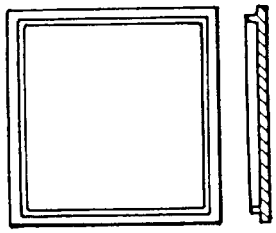

FIGS. 16A, 16B, 16C and 16D show a modification of FIG. 13 the container of FIGS. 13A, 13B and 13C. The cover in FIGS. 16A, 16B and 16C is integral with the main body of the ink container.

The embodiment shown in FIGS. 17A, 17B, 17C and 17D is a similar modification of that shown in FIGS. 15A, 15B and 15C, in which the member having the inclined surface and the container main body are integral with each other.

Figure 18:
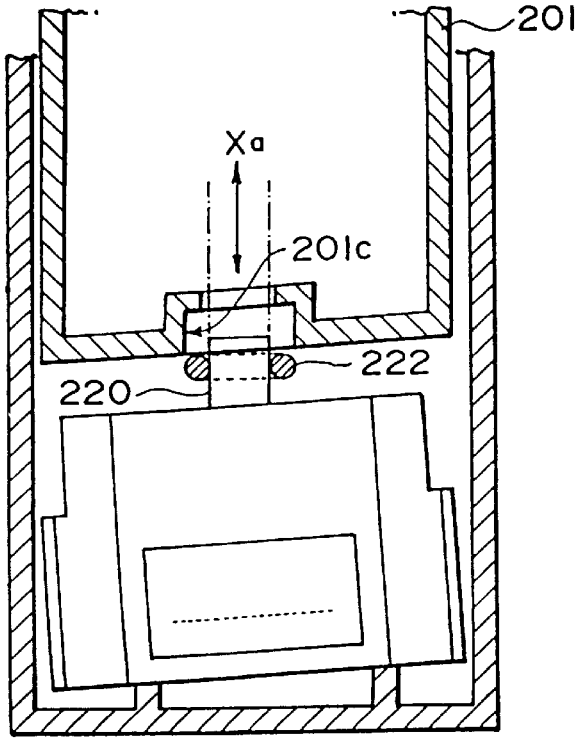
FIG. 18 illustrates an ink container using a sealing device with the sliding surface.

FIG. 18 shows motion of the O-ring in a further embodiment in which the function of the O-ring is different from described above. The sealing operation of the O-ring is accomplished by a surface 201 which is parallel with the ink demounting direction. The sliding surface 201*c* of the ink container of FIG. 18 and the side surface 220 of the ink inlet portion of the recording head, are concerned with the sealing function. In this system, the sealing is maintained even if no large force is applied in the demounting direction, and therefore, the mechanism is advantageous over the foregoing embodiments.

Figure 19:
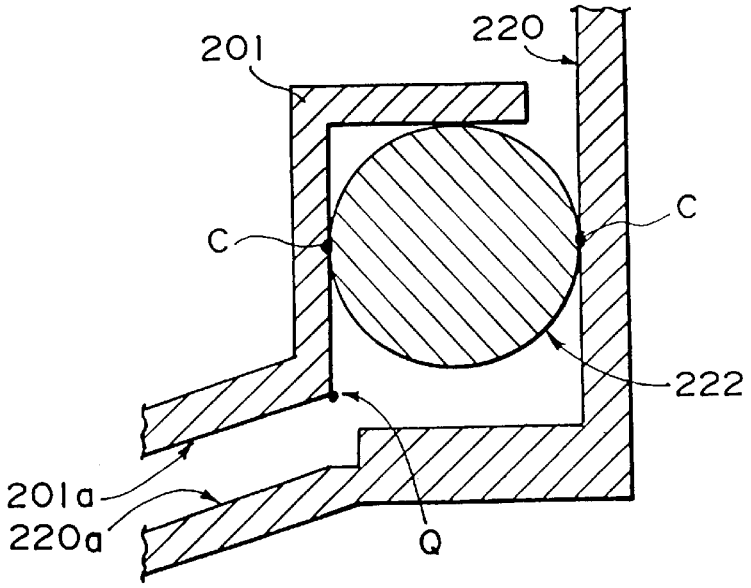
FIG. 19 illustrates the sealing function.
Figure 20A:
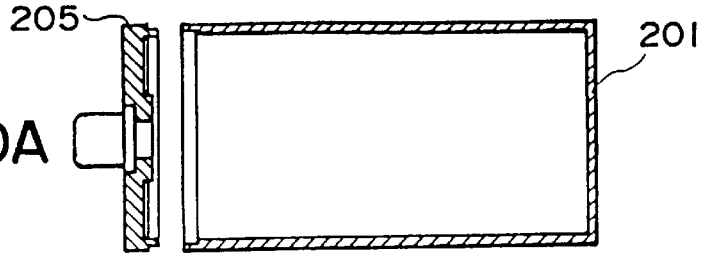
FIGS. 20A, 20B, 20C, 21A, 21B, and 21C show ink containers according to other embodiments of the present invention.
Figure 20C:
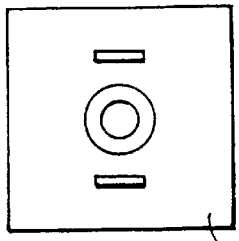
Figure 20B:
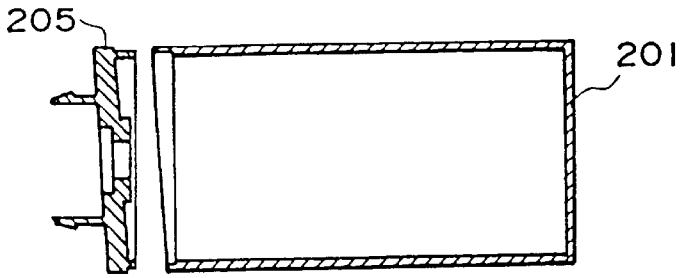
Figure 21A:
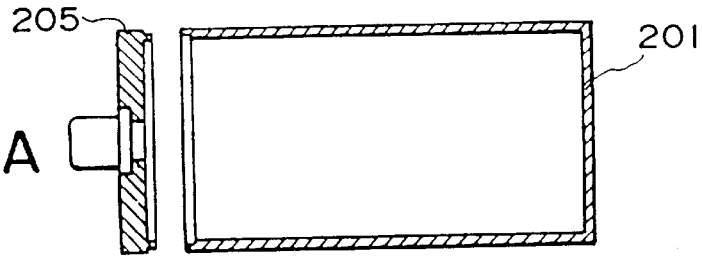
Figure 21C:
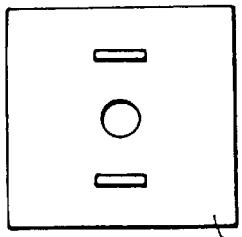
Figure 21B:
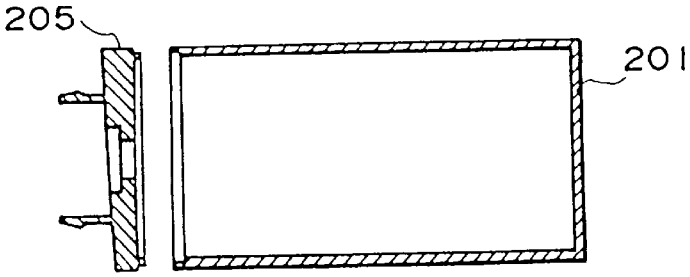

FIG. 19 shows the connecting portion in more detail. The sealing portion of the ink container and the sealing portion of the recording head, are indicated by C. In this example, the diameter of the sliding surface of the ink container is slightly smaller than the outer diameter of the O-ring. For this reason, the force perpendicular to the sliding surface is applied to accomplish the sealing function. In this embodiment, the inclination angle relative to a plane perpendicular to the ink container mounting and demounting direction is significant. Similarly to the foregoing, the O-ring sticks to the ink inlet portion of the recording head, after substantial time period elapses after the manufacturing. Therefore, upon the first connection between the ink container and the recording head, does not slide smoothly with the result of improper sealing function. Therefore, similarly to the foregoing embodiment, it is desirable to urge the O-ring at one side at the initial stage. This is accomplished, in this embodiment, by inclining the connecting surface of the recording head and the connecting surface of the ink container, are inclined with respect to a plane perpendicular to the mounting and demounting direction of the ink container, as shown in FIG. 19. Because of the inclination angle, upon the connection with the ink container, a point Q which is an edge of the connecting surface of the ink container 201, is first contacted to the O-ring. Similarly to the foregoing embodiments, the O-ring starts to be urged at one side. Thus, the stuck O-ring becomes movable to accomplish the proper sealing function.

FIGS. 20A, 20B, 20C, 21A, 21B and 21C show the ink containers of this example. In these examples, the thickness of the cover of the ink container is different. Similarly to FIGS. 14A, 14B and 14C, a recess for receiving O-ring is provided, but in order to provide large area of the sliding portion at the side of the recess, the depth of the recess is large.

In the foregoing descriptions, an O-ring has been used for the close contactness between the ink container and the recording head. However, the O-ring is not inevitable, but another member, for example a washer (flat disklike member of a rubber material which may be produced by punching), may be used. In that case, the present invention is advantageous for the same reasons.

The angle between the connecting surfaces of the ink container and the ink jet recording head, are preferably empirically 0.5 degree relative to a surface perpendicular to the ink container mounting and demounting direction. It is preferably large. However, if the angle is too large, a space not contributable to the ink container or recording head, is required with the result of lower volume efficiency, and therefore, it is not desirable for a small size printer. For example, in the case that the cross-sectional area of the ink container is 20 mm×20 mm and the length thereof is approx. 40 mm, using foamed polyurethane material as the ink absorber, the limit of the angle is approx. 30 degrees. If the angle is too large, an inside wedged space provided by the inclination angle, can not receive the ink absorbing material sufficiently into the end of the wedge, and therefore, the volume not contributable to the ink absorption is produced. However, this depend on the flexibility of the absorbing material, and therefore, the above-described limit value is not strict.

In the foregoing descriptions, the sealing members are set in the projection of the recording head. Conversely, however, the projection may be formed on the ink container side, and the sealing member may be disposed around the circumference thereof the sealing member is urged by the connecting surface of the recording head without the deterioration of the advantageous effects of the present invention.

Figure 23A:
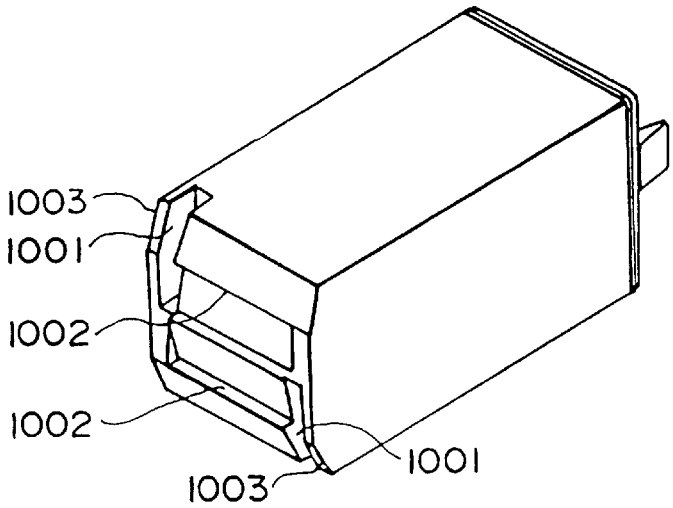
FIGS. 23A, 23B and 23C schematically show the container usable with an ink jet cartridge according to an embodiment of the present invention.
Figure 23B:
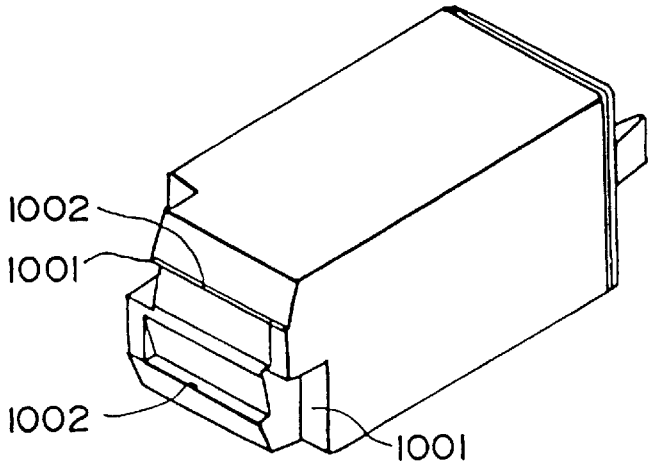
Figure 23C:
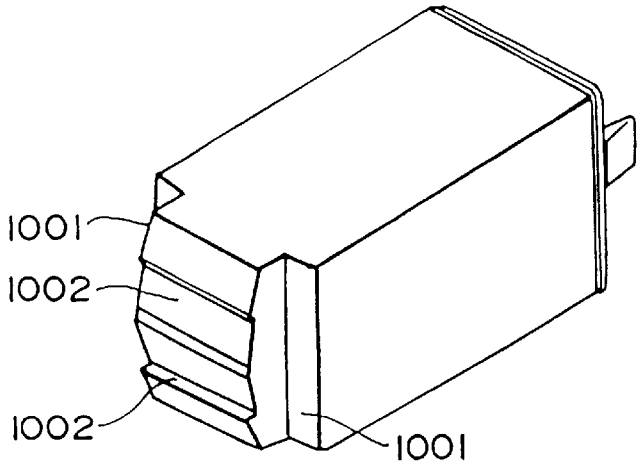

FIGS. 23A, 23B and 23C, are perspective views of ink containers of an ink jet head cartridge with which the present invention is usable. The ink container shown in the Figure is an ink container capable of being mounted to a carriage of the recording apparatus in vertically opposite two directions. There are provided an ink supply port (not shown) connected with the ink container portion to supply the ink to the recording head, and an air vent (not shown) for communicating the inside of the ink container with the ambience. A claw 1002 functioning as a stopper when the ink container is removed from the recording apparatus, and a cut-away portion 1001 for engagement with a projection of the recording apparatus upon the mounting on the recording apparatus, are provided at corresponding two positions, corresponding to two vertical opposite positions of the ink container.

In FIG. 23A, the cut-away portion described above is disposed inside from the ink container, and therefore, upon the mounting on the recording apparatus, the projection of the recording apparatus can be protected from the external condition.

In FIGS. 23B and 23C, there is no side wall of the ink container, and therefore, the above-described protection effect is not provided, but the manufacturing of the ink container is easy.

In the foregoing, the description has been made as to an ink jet head, an ink container and an ink jet cartridge comprises them, and an ink jet apparatus having the ink jet cartridge.

The description will be made as to the recording apparatus using one or more of the above-described embodiments.

Next, an apparatus employing a recording apparatus incorporating the aforementioned various elements will be described.

Figure 24:
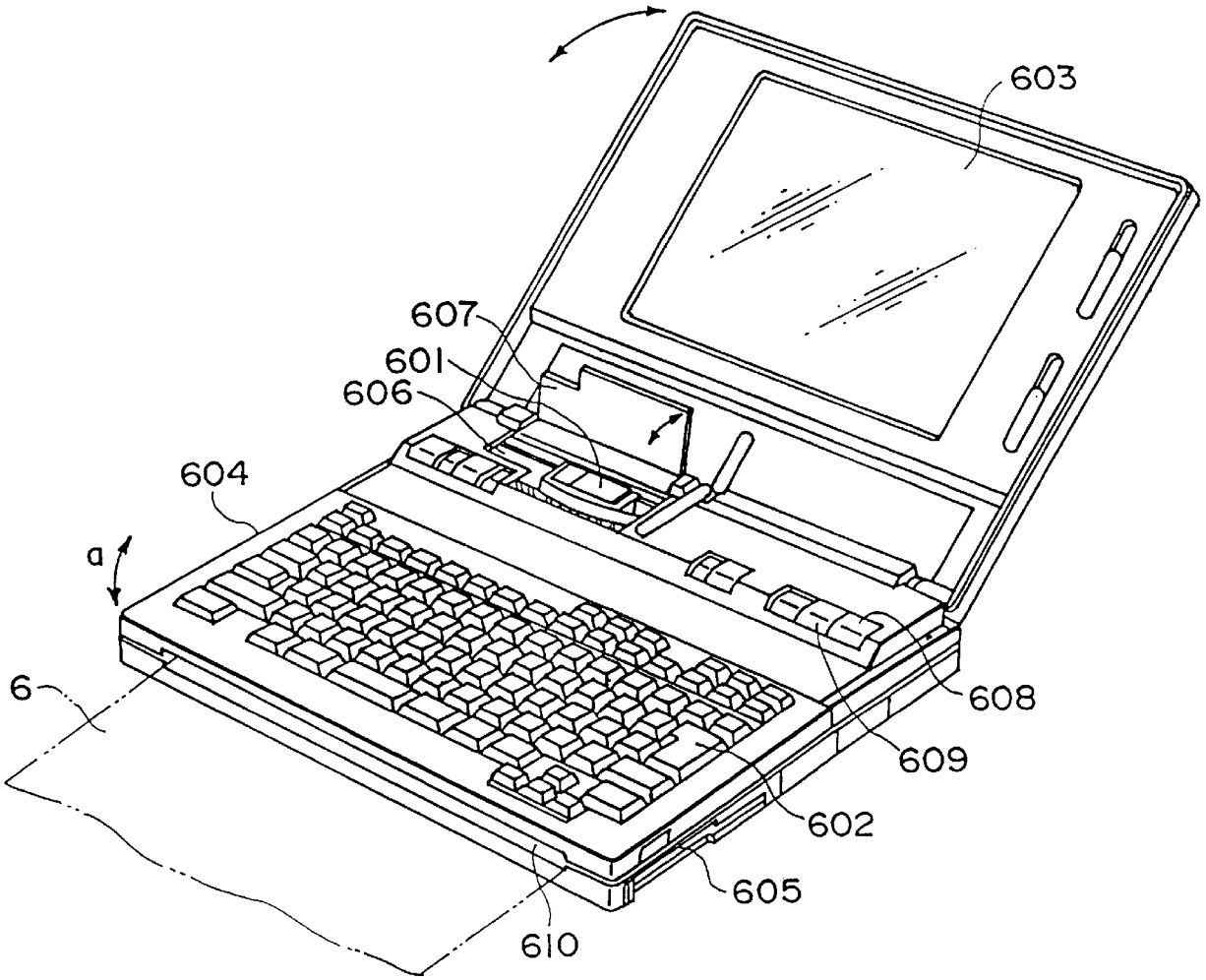
FIG. 24 is a schematic perspective view of an information processing apparatus comprising the ink jet recording apparatus according to the first embodiment of the present invention.

FIG. 24 is a perspective view of an outer appearance of an information processing apparatus 604 incorporating the recording apparatus of this embodiment. In the Figure, a reference numeral 601 designates a printer described above; 602, a keyboard provided with character numerical, other character keys and command keys; 603, a display portion with a display; 606, a window for permitting exchange of the recording head 200 and/or the ink container 21 described hereinbefore; 607, an openable cover for covering the window 606 other than when they are exchanged. The window 606 has a size enough to permit manipulation of the head lever 204 and the container lever 205 upon the ink container 201 exchange. A reference numeral 608 designates an exchanging switch for exchange of the recording head 200 and/or the ink container 201. When the exchanging switch 608 is actuated, the carriage motor 402*a* is driven, so that the carriage 203 is moved from the home position or the recording region to the window 606 position. At this position, when the exchange of the recording head 200 or the ink container 201 is completed, a release switch 609 is actuated. Then, the carriage 203 is returned to the home position, and thereafter, the recovery unit 271 carries out the recovery operation including sucking or ejecting the ink and wiping the recording head. Subsequently, the state before the exchange switch 608 is actuated, is established. The recording material is supplied to the printer 601 through a sheet supply port 610. The keyboard 602 is openable in a direction a for setting the recording material 6.

Figure 25:
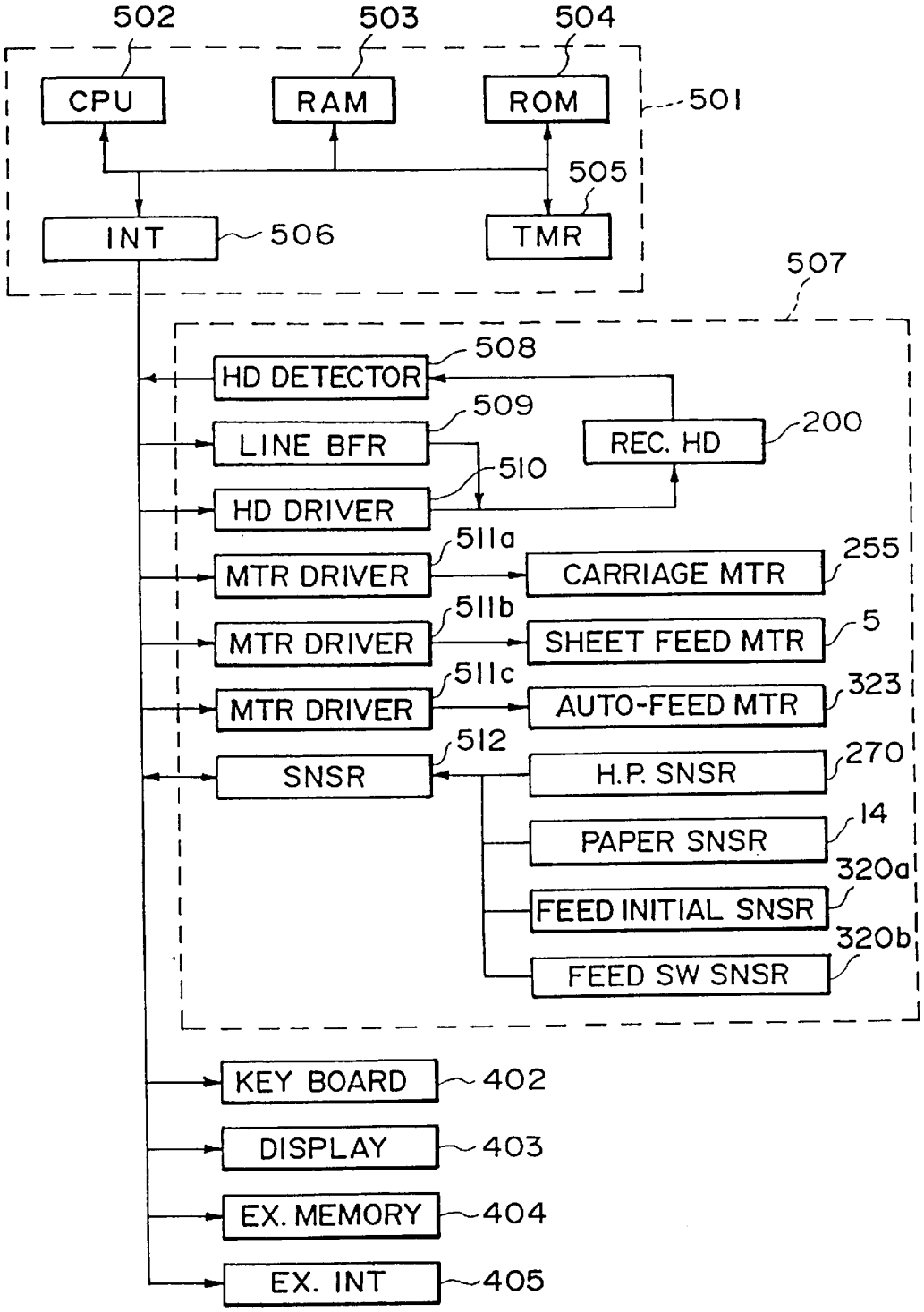
FIG. 25 is a block diagram of an electric circuit of the information processing apparatus including the ink jet recording apparatus according to the first embodiment.
Figure 26B:
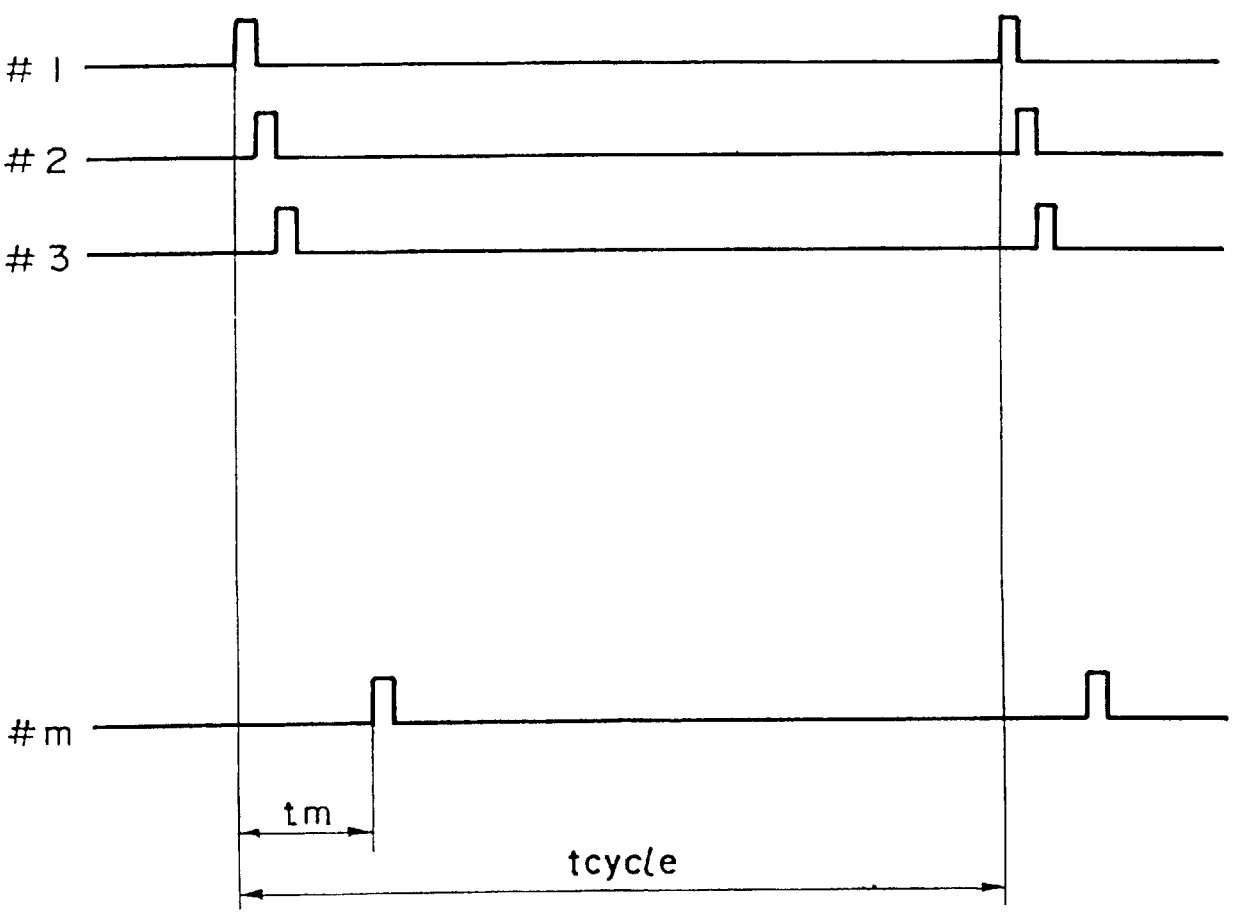
FIG. 26B PRIOR ART
FIGS. 26A and 26B respectively illustrates timing charts, the nozzle arrangement and the ejection timing of a recording head according to background art.
Figure 26A:
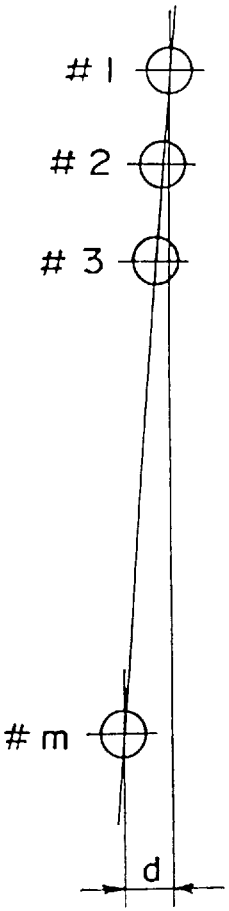
FIG. 26A PRIOR ART
Figure 27:
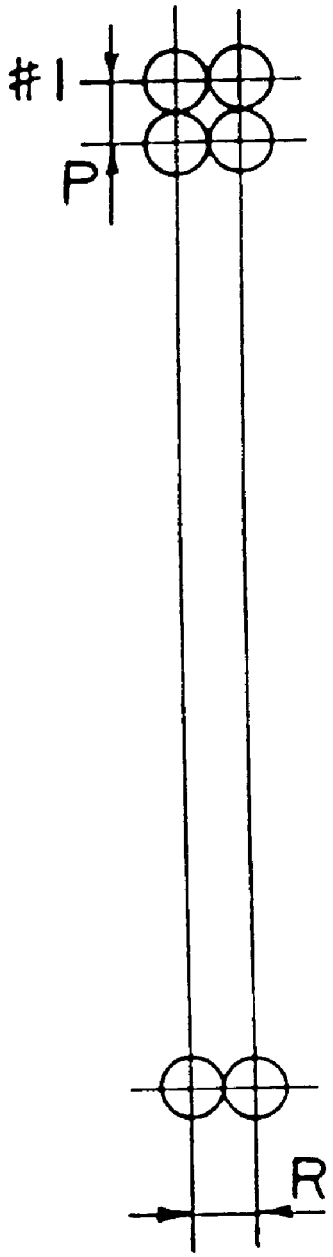
FIG. 27 PRIOR ART
FIG. 27 shows result of recording in the background art.
Figure 28A:
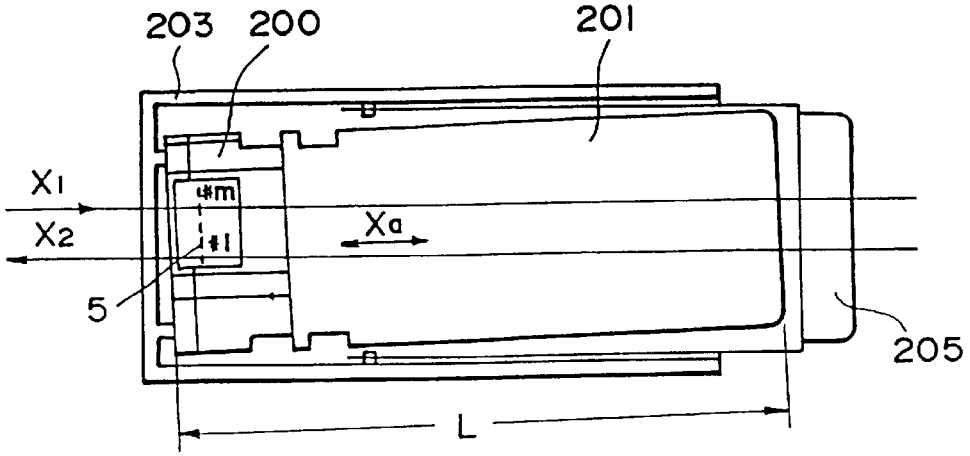
FIGS. 28A, 28B and 28C are schematic views illustrating the mounting and demounting direction among the carriage, the recording head and the ink container of the background art ink jet recording apparatus.
Figure 28B:
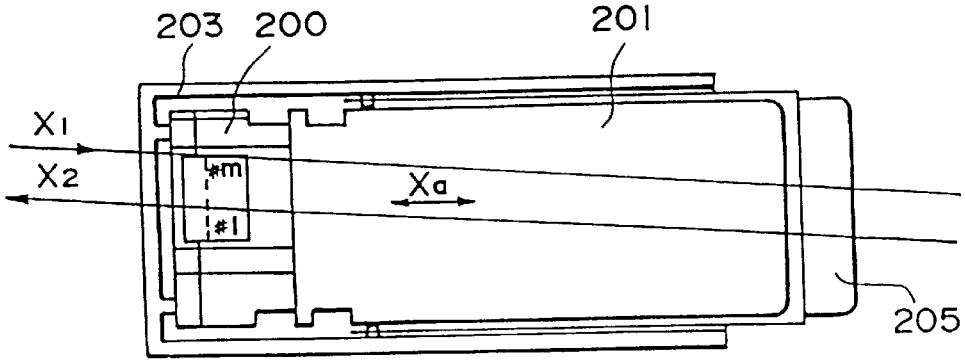
Figure 28C:
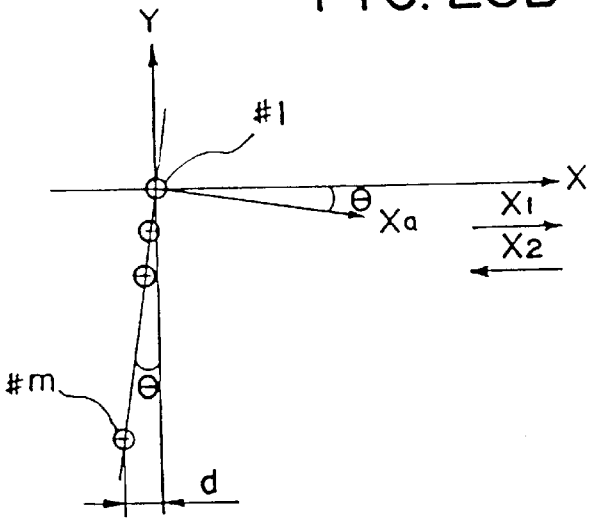
Figure 29:
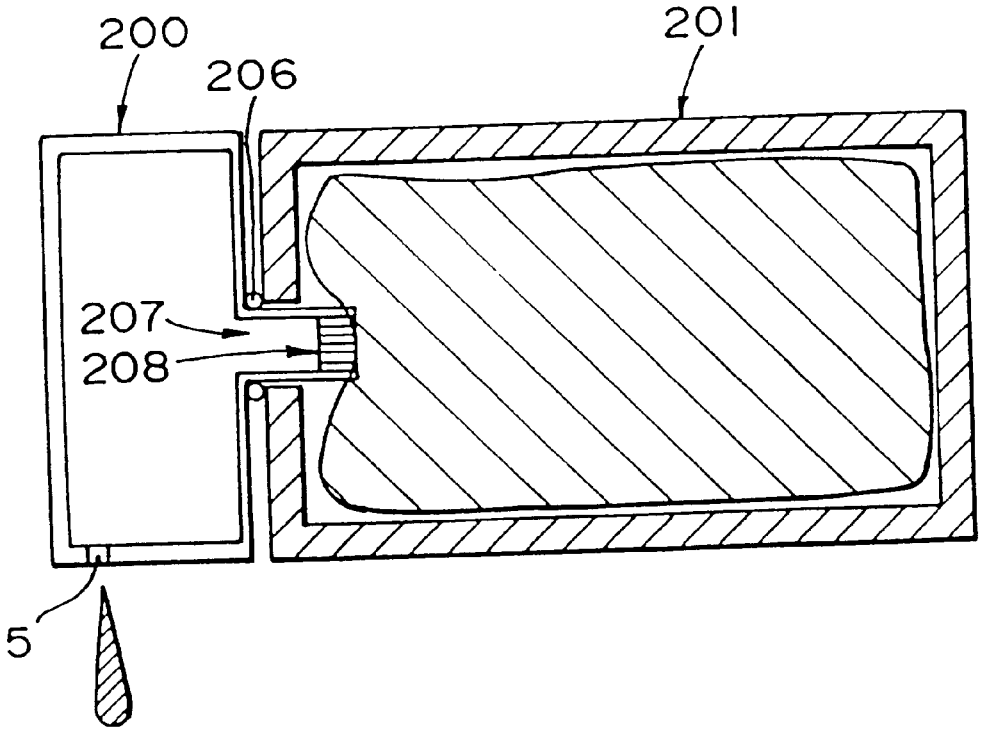
FIG. 29 illustrates an ink jet cartridge according to background art.

FIG. 25 is a block diagram of the electric circuit structure of the information processing apparatus. In this Figure, a reference numeral 501 is a controller for the main control operation; 502, a CPU in he form of a microcomputer, for example, for carrying out various processes; 503, a RAM including an area for developing text data or image data and a work area; 504, a ROM for storing fixed data such as the program for the sequential operations and font data; 505, a timer for producing executing cycle of the CPU 502 and producing necessary timing for the recording operation of the printer 401; 506, an interface for supplying the signals from the CPU 502 to the peripheral device.

In addition, a reference numeral 507 designates a controller for the printer 401; 508, is a recording head detector for detecting information on the recording head such as outputs of sensors for detecting presence or absence of the recording head 200, the types thereof and the temperature thereof and outputs of the sensor for detecting presence or absence of the ink in the ink container 201; 509, a line buffer for storing record data for the recording head 200; 510, a head driver for supplying the recording signal and the electric power to the recording head 200; 511*a*, 511*b* and 511*c* are motor drivers for supplying necessary signals and electric power for operation of the carriage motor4 255, the sheet feeding motor 5 and automatic sheet feed motor 323; 512, sensor detectors for detecting outputs of sensors such as the home position sensor 270, the paper sensor 14, the sheet feed initial sensor 320*a*, the sheet feed switch sensor 320*b* or the like. Furthermore, a reference numeral 404 designates an external memory such as FDD, HDD, RAM card or the like; and 405 is an external interface for connection directly with another information processing apparatus or for connection directly with an internal bus to control the peripheral devices. Although not shown in the block diagram, there is a power source for supplying electric power to the above electric circuits. The power source may be in the form of a chargeable battery, a disposable dry battery or an AC source converter fixedly used with the main assembly of the information processing apparatus.

As described in the foregoing, according to the embodiments of the present invention, the carriage movement direction is in accord with the mounting or demounting direction of the ink container by inclining the connecting surface of the ink container or the recording head with respect to the mounting and demounting direction of the recording head and the ink container, even if the array of the nozzles in the recording head is inclined to prevent the recording position deviation. Furthermore, the projection area, in the carriage movement direction of the connected recording head and ink container, is minimized. Therefore, without the difficulty in the connection between the recording head and the container the size of the ink jet recording apparatus can be reduced. In addition, the connecting direction between the ink container and the recording head, is inclined with respect to the direction of the array of the ejection outlets, and therefore, the correct recording position can be accomplished irrespective of the state of the mounting of the ink jet cartridge on the carriage. According to embodiments of the present invention, the connecting surfaces of the ink container and the recording head, are inclined with respect to a surface perpendicular to the ink container mounting and demounting direction. Therefore, particularly after the time elapses after the manufacturing, the O-ring is prevented from stacking on the sliding surface upon the connection of the ink container by the user. Therefore, the inconveniences of improper printing due to the ink disconnection or large amount of unusable ink remained.

Because of the inclination angle relative to a plane vertical to the mounting direction of the ink container, a force along the connecting surface is produced as a component force of the force applied in the mounting direction, upon the connection of the ink container. The force tends to produce relative deviation between the ink container and the ink jet recording head along the connecting surface. This force is eventually received by an engaging claw or the like. Therefore, it may be correctly position in the direction along the connecting surface, without the necessity for a particular fixing pin or force producing means not concerned with the mounting or demounting action. Therefore, an ink jet recording cartridge which is highly reliable even against the vibration or the like, can be provided.

Figure 22:
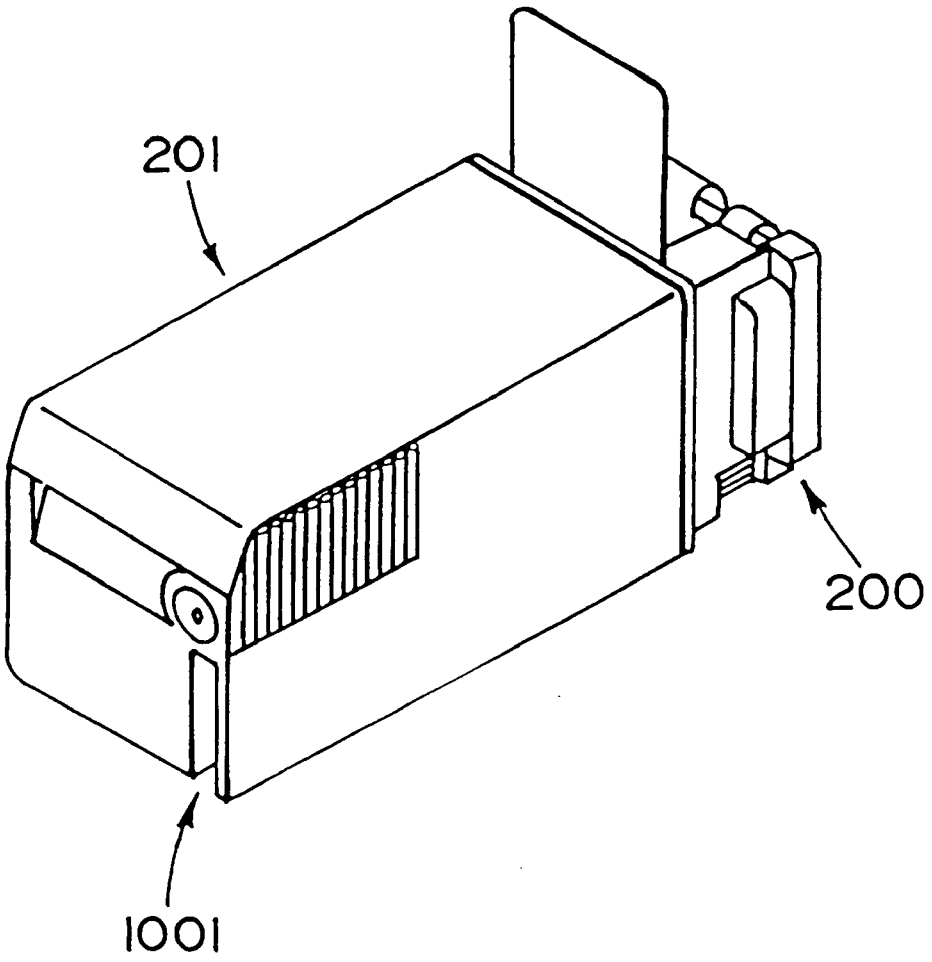
FIG. 22 is a perspective view illustrating the advantageous effects of the present invention.

The inclination angle is effective to prevent erroneous insertion of the ink container or the like. For example, an erroneous insertion preventing groove may be provided at a side opposite from the connecting surface, as shown in FIG. 22. This groove remarkably reduces the inside volume of the ink container. By using the inclination angle of this invention, the erroneous insertion can be avoided without significantly reducing the usable volume of the ink container. It may be used for distinction of the color by using different inclination angles for the respective colors, in the recently demanded color printing machines.

While the invention has been described with reference to the structures disclosed herein, it is not confined to the details set forth and this application is intended to cover such modifications or changes as may come within the purposes of the improvements or the scope of the following claims.

What is claimed is:

1. An ink jet cartridge including an ink jet recording head for ejecting ink through a plurality of ejection outlets to effect recording on a recording material by scanning in a scanning direction and an ink container for containing ink to be supplied to the recording head, the ink container being detachably mountable relative to the recording head in a mounting direction parallel to the scanning direction;

wherein a line along which said ejection outlets are arranged is inclined with respect to a plane perpendicular to the mounting direction and is different from the scanning direction.

2. An ink jet cartridge according to claim 1, wherein said ejection outlets are arranged into an array of ejection outlets, and further comprising an ink receiving portion for receiving the ink to be ejected through the array of ejection outlets.

* * * * *

UNITED STATES PATENT AND TRADEMARK OFFICE

CERTIFICATE OF CORRECTION

PATENT NO. : 6,203,149 B1
DATED : March 20, 2001
INVENTOR(S) : Watanabe et al.

It is certified that error appears in the above-identified patent and that said Letters Patent is hereby corrected as shown below:

Column 1,
Line 37, “df” should read -- of --;
Line 40, “nozzles,” should read -- nozzle, --; and
Line 53, “t cycle” should read -- $t_{cycle}$ --.

Column 2,
Line 12, “28C,” should read -- 28C --;
Line 14, “28B” should read -- 28B, --;
Lines 18 and 21, “container,” should read -- container --;
Line 24, “movement,” should read -- movement --;
Line 28, “arranged” should read -- arrangement --;
Line 42, “with” should read -- with an --;
Line 43, “as” should read -- as a --;
Line 51, “With the tendency of the” should read -- With an increasingly --;
Line 52, “the” should read -- this --;
Line 62, “the” (second occurrence) should read -- there being a sufficient --;
Line 63, “material” should read -- material. --; and “is” should be deleted; and
Line 64, “sufficient.” should be deleted.

Column 3,
Line 5, “remains” should read -- remaining --;
Line 10, “porous absorbing material containing the” should read -- needle. --;
Line 11, “ink.” should be deleted; and “the” (second occurrence) should be deleted;
Line 19, “plant,” should read -- manufacturing plant --;
Line 24, “this,” should read -- this --;
Line 31, “occurs,” should read -- occur --;
Line 35, “constituting” should read -- constituting the --;
Line 36, “being” should be deleted;
Line 40, “slides” should read -- slide --;
Line 47, “with” should read -- in --; and
Line 50, “portion,” should read -- portion --.

Column 4,
Line 14, “in” should read -- of --; and
Line 64, “illustrates” should read -- illustrate --.

UNITED STATES PATENT AND TRADEMARK OFFICE

CERTIFICATE OF CORRECTION

PATENT NO. : 6,203,149 B1
DATED : March 20, 2001
INVENTOR(S) : Watanabe et al.

It is certified that error appears in the above-identified patent and that said Letters Patent is hereby corrected as shown below:

Column 5,
Line 1, “illustrates” should read -- illustrate --;
Line 29, “respectively illustrates timing charts” should read -- are timing charts respectively illustrating --;
Line 32, “shows” should read -- shows the --; and
Line 63, “reciprocable” should read -- reciprocal --.

Column 6,
Lines 8 and 11, “hereinafter.” should read -- later. --;
Line 13, “203” should read -- 200 --;
Line 18, “(orifice)” should read -- (orifices) --;
Line 20, “droplet,” should read -- droplets. --;
Line 22, “element” should read -- elements --;
Line 23, “electromagnetic” should read -- an electromagnetic --; and “as” should read -- as a --;
Line 24, “and” should read -- and an --; and
Line 36, “recently” should read -- recently more --.

Column 7,
Line 4, “with” should read -- with an --; and
Line 30, “in” should read -- in a --.

Column 8,
Line 1, “a’” should read -- a --;
Line 23, “projection sin” should read -- projections in --;
Line 25, “Since the” should read -- The --;
Line 30, “pads” should read -- pad --;
Line 36, “point” should read -- pins --;
Line 39, “engages” should read -- engage --;
Line 43, “by” should be deleted; and
Line 55, “is a schematic view” should read -- are schematic views --.

Column 9,
Line 11, “each other” should read -- the container --;
Line 18, “direction” should read -- directions --; and
Line 21, “(demounting)” should read -- (or demounting) --;
Line 29, “the influence to” should read -- affecting --;
Line 35, “shows” should read -- show --;
Line 45, “ink” should read -- an ink --; and “portion,” should read -- portion --;
Line 46, “(projection)” should read -- (the projecting) --;

UNITED STATES PATENT AND TRADEMARK OFFICE

CERTIFICATE OF CORRECTION

PATENT NO. : 6,203,149 B1
DATED : March 20, 2001
INVENTOR(S) : Watanabe et al.

It is certified that error appears in the above-identified patent and that said Letters Patent is hereby corrected as shown below:

Column 9 cont'd,
Line 50, "invention," should read -- invention --;
Line 52, "colors," should read -- colors --; and
Line 67, "cycle." should read -- $t_{cycle}$. --.

Column 10,
Line 42, "on the way of" should read -- in the process of --;
Line 60, "dried ," should read -- dried, --; and
Line 63, "surface," should read -- surface --.

Column 11,
Line 1, "surface," should read -- surface --;
Line 16, "seams" should read -- seems --;
Line 17, "Actually however," should read -- However, --;
Line 28, "container," should read -- container --;
Line 32, "becomes" should be deleted;
Line 37, "direction," should read -- direction --;
Lines 40 and 66, "shows" should read -- show --.

Column 12,
Line 1, "12A" should read -- 12A, --;
Line 10, "FIG. 13" should be deleted;
Lines 11 and 16, "with" should read -- to --;
Line 30, "head," should read -- head --;
Line 41, "head," should read -- head, the O-ring --;
Line 47, "container, are inclined" should read -- container --;
Line 59, "receiving" should read -- receiving the --; and
Line 60, "provide" should read -- provide a --.

Column 13,
Line 5, "are" should read -- is --;
Line 7, "direction. It" should read -- direction, and --;
Line 9, "head," should read -- head --;
Line 17, "angle, can not" should read -- angle cannot --;
Line 20, "depend" should read -- depends --;
Line 27, "thereof the" should read -- thereof when the --;
Line 35, "vertically opposite two" should read -- two vertically opposite --;
Line 44, "corresponding two" should read -- two corresponding --;
Line 48, "from" should be deleted;

UNITED STATES PATENT AND TRADEMARK OFFICE

CERTIFICATE OF CORRECTION

PATENT NO. : 6,203,149 B1
DATED : March 20, 2001
INVENTOR(S) : Watanabe et al.

It is certified that error appears in the above-identified patent and that said Letters Patent is hereby corrected as shown below:

Column 13 cont'd,
Line 51, "condition" should read -- conditions --; and
Line 58, "comprises" should read -- comprising --.

Column 14,
Line 29, "he" should read -- the --; and
Line 50, "motor4 255," should read -- motor 255, --.

Column 15,
Line 11, "container" should read -- container, --;
Lines 13 and 19, "head," should read -- head --; and
Line 36, "position" should read -- positioned --.

Signed and Sealed this

Sixteenth Day of July, 2002

*Attest:*

*Attesting Officer*

JAMES E. ROGAN
*Director of the United States Patent and Trademark Office*